US009176428B2

(12) United States Patent
Mori

(10) Patent No.: US 9,176,428 B2
(45) Date of Patent: Nov. 3, 2015

(54) CARTRIDGE AND IMAGE FORMING DEVICE

(71) Applicant: Brother Kogyo Kabushiki Kaisha, Nagoya (JP)

(72) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,131

(22) Filed: Jan. 9, 2015

(65) Prior Publication Data

US 2015/0117906 A1 Apr. 30, 2015

Related U.S. Application Data

(63) Continuation-in-part of application No. PCT/JP2012/080832, filed on Nov. 29, 2012.

(30) Foreign Application Priority Data

Jul. 9, 2012 (JP) ..... 2012-154141

(51) Int. Cl.
*G03G 15/08* (2006.01)
*G03G 21/18* (2006.01)
*G03G 21/16* (2006.01)

(52) U.S. Cl.
CPC ..... *G03G 15/0889* (2013.01); *G03G 21/1647* (2013.01); *G03G 21/1857* (2013.01); *G03G 2221/1657* (2013.01)

(58) Field of Classification Search
CPC ..... G03G 15/0822; G03G 15/0889; G03G 15/757; G03G 21/1647; G03G 21/1857; G03G 2221/1657
USPC ..... 399/111, 167, 254–256
See application file for complete search history.

(56) References Cited

U.S. PATENT DOCUMENTS 7,574,148 B2 8/2009 Igarashi et al.
7,853,158 B2 12/2010 Mikuni (Continued)

FOREIGN PATENT DOCUMENTS

JP H09-258634 A 10/1997
JP H09-300993 A 11/1997

(Continued)

OTHER PUBLICATIONS

Jan. 22, 2015—(WO) International Preliminary Report on Patentability—App PCT/JP2012/080832, Eng Tran.

(Continued)

*Primary Examiner* — Hoang Ngo
(74) *Attorney, Agent, or Firm* — Banner & Witcoff, Ltd.

(57) ABSTRACT

A cartridge includes: a casing including a developer accommodation part for accommodating developer; an agitator for agitating the developer and rotatable about a first rotational axis extending in an axial direction; a receiving member rotatable about a second rotational axis upon receipt of a drive force inputted thereto; a first drive-force transmission member rotatable about a third rotational axis upon receipt of the drive force from the receiving member; and a second drive-force transmission member rotatable about the first rotational axis together with the agitator. The second drive-force transmission member can contact the first drive-force transmission member and receive the drive force therefrom, the first rotational axis being positioned closer to the second rotational axis than the third rotational axis is to the second rotational axis when projected in the axial direction of the agitator.

12 Claims, 15 Drawing Sheets

(56) References Cited

U.S. PATENT DOCUMENTS

| | | | | |
|---|---|---|---|---|
| 7,991,322 | B2 * | 8/2011 | Ukai | 399/111 |
| 8,620,180 | B2 * | 12/2013 | Shiraki et al. | 399/111 |
| 8,712,286 | B2 | 4/2014 | Takagi | |
| 2007/0122165 | A1 | 5/2007 | Igarashi et al. | |
| 2008/0205911 | A1 | 8/2008 | Ishikawa et al. | |
| 2008/0223173 | A1 | 9/2008 | Ishikawa | |
| 2009/0269086 | A1 | 10/2009 | Mikuni | |
| 2011/0236065 | A1 | 9/2011 | Takagi | |
| 2012/0051795 | A1 | 3/2012 | Mushika et al. | |
| 2015/0117873 | A1 | 4/2015 | Mori et al. | |

FOREIGN PATENT DOCUMENTS

| | | | |
|---|---|---|---|
| JP | 2007-148285 | A | 6/2007 |
| JP | 2008-216394 | A | 9/2008 |
| JP | 2009-244564 | A | 10/2009 |
| JP | 2009-265401 | A | 11/2009 |
| JP | 2010-128115 | A | 6/2010 |
| JP | 2011-013323 | A | 1/2011 |
| JP | 3167020 | U | 3/2011 |
| JP | 2011-203366 | A | 10/2011 |
| JP | 2012-013763 | A | 1/2012 |
| JP | 2012-053095 | A | 3/2012 |

OTHER PUBLICATIONS

Jan. 22, 2015—(WO) International Preliminary Report on Patentability—App PCT/JP2012/080825, Eng Tran.

* cited by examiner

CARTRIDGE AND IMAGE FORMING DEVICE

CROSS REFERENCE TO RELATED APPLICATION

This application claims priority from Japanese Patent Application No. 2012-154141 filed Jul. 9, 2012. This application is also a continuation-in-part of International Application No. PCT/JP2012/080832 filed Nov. 29, 2012 in Japan Patent Office as a Receiving Office. The entire contents of both applications are incorporated herein by reference.

TECHNICAL FIELD

The present invention relates to a cartridge that is mounted in an image forming device employing an electrophotographic system and to the image forming device in which this cartridge is mounted.

BACKGROUND

As a conventional image forming device that employs an electrophotographic system, there is known a printer provided with a photosensitive member, and a developer cartridge that supplies toner to the photosensitive member.

As an example of a developing cartridge provided in this type of printer, there is known a developing cartridge having a casing that includes: a toner accommodating chamber configured to accommodate toner and provided with an agitator for agitating the toner; and a developing chamber supporting a developing roller and a supply roller (see Japanese Patent Application Publication no. 2012-53095, for example).

In this developing cartridge, driving force from a main casing is configured to be transmitted from a receiving gear for receiving the driving force, via an intermediate gear engaging the receiving gear, to an agitator gear for driving the agitator.

SUMMARY

However, in the above-described developing cartridge, the intermediate gear is interposed between the receiving gear and agitator gear to determine a rotational direction of the agitator gear and to drive the agitator gear. Further, the receiving gear, intermediate gear and agitator gear are arranged in line in a front-rear direction.

This structure prevents downsizing of the developing cartridge while securing a space for arranging these gears.

In view of the foregoing, it is an object of the present invention to provide a cartridge that can be made more compact, and an image forming device in which this cartridge is mounted.

In order to attain the above and other objects, there is provided a cartridge that may include a casing, an agitator, a receiving member, a first drive-force transmission member, and a second drive-force transmission member. The casing includes a developer accommodation part configured to accommodate developer therein. The agitator defines a first rotational axis extending in an axial direction and configured to rotate about the first rotational axis and agitate the developer within the developer accommodation part. The receiving member is configured to rotate about a second rotational axis upon receipt of a drive force inputted thereto. The first drive-force transmission member is configured to rotate about a third rotational axis upon receipt of the drive force from the receiving member. The second drive-force transmission member is configured to contact the first drive-force transmission member and receive the drive force therefrom, the second drive-force transmission member being configured to rotate about the first rotational axis together with the agitator, the first rotational axis being positioned closer to the second rotational axis than the third rotational axis is to the second rotational axis when projected in the axial direction of the agitator.

According to another aspect of the present invention, there is provided an image forming device that may include a main body and a cartridge configured to be mounted in and removed from the main body. The cartridge includes: a casing including a developer accommodation part configured to accommodate developer therein; an agitator configured to agitate the developer within the developer accommodation part; a receiving member; a first drive-force transmission member; and a second drive-force transmission member. The agitator defines a first rotational axis extending in an axial direction and is configured to rotate about the first rotational axis.

The receiving member is configured to rotate about a second rotational axis upon receipt of a drive force inputted thereto. The first drive-force transmission member is configured to rotate about a third rotational axis upon receipt of the drive force from the receiving member. The second drive-force transmission member is configured to contact the first drive-force transmission member and receive the drive force therefrom, the second drive-force transmission member being configured to rotate about the first rotational axis together with the agitator, the first rotational axis being positioned closer to the second rotational axis than the third rotational axis is to the second rotational axis when projected in the axial direction of the agitator. When the cartridge is mounted in the main body, the first drive-force transmission member is configured to transmit the drive force to the second drive-force transmission member at a drive-force transmission portion, the drive force being oriented toward vertically below relative to the second drive-force transmission member at the drive-force transmission portion.

DETAILED DESCRIPTION

1. Printer

Figure 1:
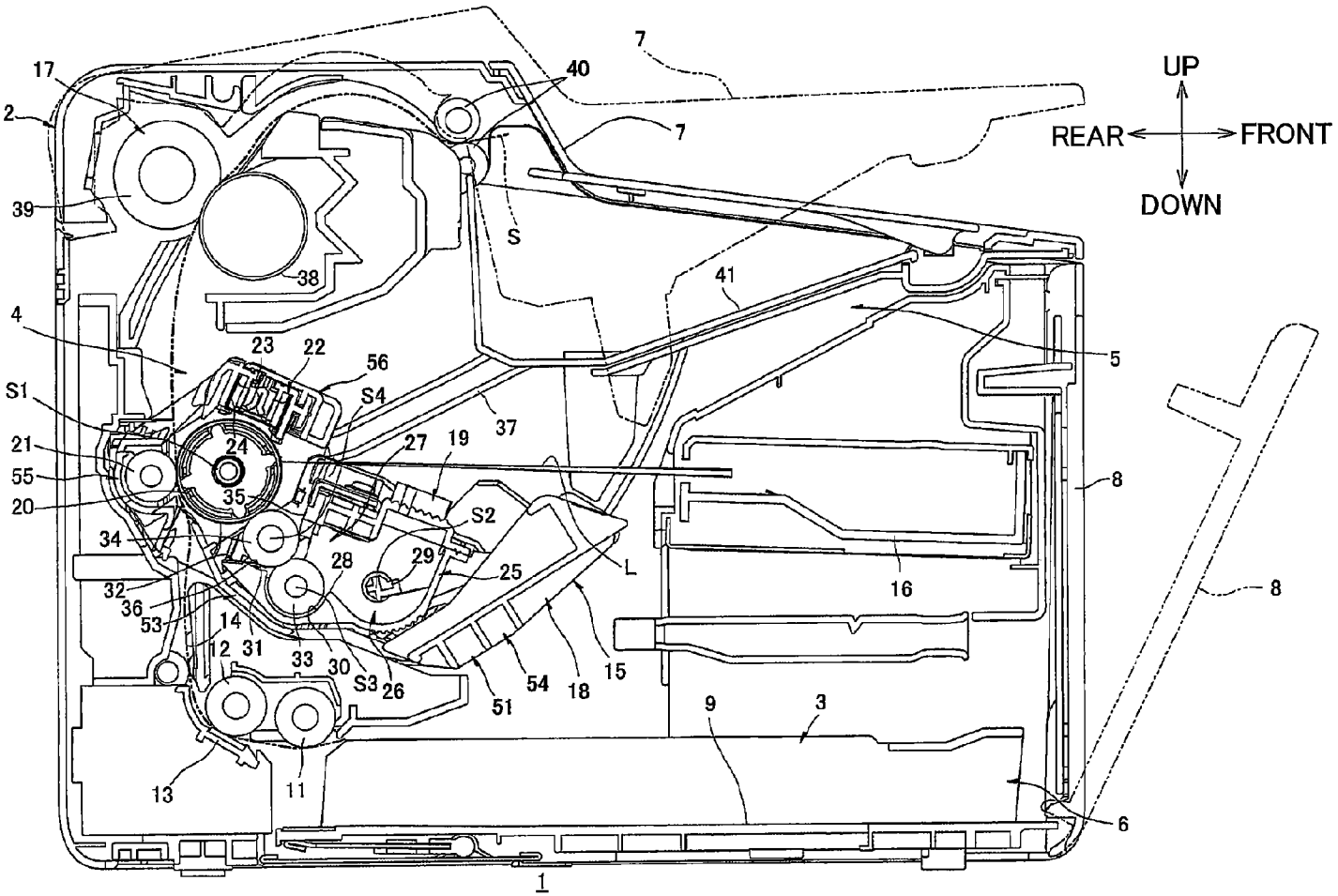
FIG. 1 is a central cross-sectional view of a printer as an image forming device according to a first embodiment of the present invention.

FIG. 1 shows a printer 1 serving as an example of an image forming device according to a first embodiment of the present invention. The printer 1 has a developing cartridge 19 according to the first embodiment of the invention mounted therein. The printer 1 is provided with a main casing 2 as an example of a box-like shaped main body for the printer 1.

Within the main casing 2, the printer 1 is also provided with a sheet-feeding unit 3 for feeding sheets S of paper, and an image-forming unit 4 for forming images on the sheets S supplied by the sheet-feeding unit 3.

Directions related to the printer 1 and to a process cartridge 15 (described later) will be specified based on orientations of these devices when resting on a level surface, and specifically will refer to the directions indicated by arrows in the drawings.

(1) Main Casing

Formed in the main casing 2 are a cartridge access opening 5 for mounting and removing the process cartridge 15 (described later), and a paper-introducing opening 6 through which the sheets S of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a front-rear direction.

The main casing 2 also includes a top cover 7 disposed on the upper end portion thereof, and a sheet-feeding cover 8 disposed on the front end portion thereof.

The top cover 7 is disposed so as to be capable of pivoting (moving) about its rear edge portion between a closed position for covering the cartridge access opening 5, and an open position for exposing the cartridge access opening 5 (see phantom lines in FIG. 1).

The sheet-feeding cover 8 is disposed so as to be capable of pivoting (moving) about its bottom edge portion between a first position for covering the paper-introducing opening 6, and a second position for exposing the paper-introducing opening 6.

(2) Sheet-Feeding Unit

The sheet-feeding unit 3 includes a sheet-supporting part 9 provided in a lower portion of the main casing 2.

The sheet-supporting part 9 is in communication with the exterior of the main casing 2 through the paper-introducing opening 6.

The sheets S of paper are placed in the sheet-feeding unit 3 when the sheet-feeding cover 8 is in its second position for exposing the paper-introducing opening 6. More specifically, the sheets S are inserted through the paper-introducing opening 6 such that rear portions of the sheets S are stacked in the sheet-supporting part 9 and front portions of the sheets S are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

The image-forming unit 4 includes the process cartridge 15, a scanning unit 16, and a fixing unit 17.

(3-1) Process Cartridge

The process cartridge 15 can be mounted in and removed from the main casing 2. When mounted in the main casing 2, the process cartridge 15 is arranged above a rear portion of the sheet-feeding unit 3.

The process cartridge 15 includes a drum cartridge 18 and the developing cartridge 19. The drum cartridge 18 is detachably mountable in the main casing 2. The developing cartridge 19 is an example of a cartridge that is detachably mountable on the drum cartridge 18.

The drum cartridge 18 includes a photosensitive drum 20, a transfer roller 21, and a scorotron charger 22.

The photosensitive drum 20 is formed in a general columnar shape that is elongated in a left-right direction (orthogonal direction). The photosensitive drum 20 is provided in a rear portion of the drum cartridge 18. The photosensitive drum 20 is provided with a rotational shaft (hereinafter called as a "drum shaft S1") whose central axis is oriented in the left-right direction, and is capable of rotating about the central axis of the drum shaft S1.

The transfer roller 21 is formed in a general columnar shape that is elongated in the left-right direction. The transfer roller 21 is provided in the rear portion of the drum cartridge 18 so as to contact the rear side of the photosensitive drum 20 with pressure.

More specifically, the transfer roller 21 is disposed on the rear side of the photosensitive drum 20 such that a central axis of the transfer roller 21 is positioned slightly lower than the central axis of the photosensitive drum 20. Note that the transfer roller 21 has a lower peripheral surface higher than a lower peripheral surface of the photosensitive drum 20. That is, a virtual line segment (not shown) connecting the central axis of the transfer roller 21 to the central axis of the photosensitive drum 20 forms an acute angle of approximately 3° with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 is arranged to confront the upper front side of the photosensitive drum 20 with a gap formed therebetween.

More specifically, the scorotron charger 22 is disposed in a position separated from the transfer roller 21 in a circumferential direction of the photosensitive drum 20. The scorotron charger 22 is disposed such that the virtual line segment (not shown) connecting the central axis of the photosensitive drum 20 with the central axis of the transfer roller 21 forms an angle of approximately 120° with a virtual line segment (not shown) connecting the central axis of the photosensitive drum 20 with a charging wire 23 (described later).

The scorotron charger 22 further includes the charging wire 23 and a grid 24.

The charging wire 23 is arranged in a taut state to extend in the left-right direction and is disposed so as to confront but remain separated from the upper front side of the photosensitive drum 20.

The grid 24 is formed to have a general U-shape in a side view with the opening of the "U" facing diagonally upward and forward so as to surround the charging wire 23 from a lower rear side thereof.

The developing cartridge 19 is disposed on the lower front side of the photosensitive drum 20. The developing cartridge 19 includes a developing-cartridge frame 25 as an example of a casing.

A toner-accommodating chamber 26 and a development chamber 27 are formed in the developing-cartridge frame 25. The toner-accommodating chamber 26 and development chamber 27 are provided side by side in the front-rear direction, with a communication opening 28 allowing communication between the two. The toner-accommodating chamber 26 and development chamber 27 have substantially the same capacity as each other. The toner-accommodating chamber 26 is an example of a developer accommodation part.

The toner-accommodating chamber 26 accommodates toner (developer). An agitator 29 is provided in an approximate front-rear and vertical center region of the toner-accommodating chamber 26. In other words, the agitator 29 is positioned lower than the photosensitive drum 20. The agitator 29 is an example of an agitator.

The agitator 29 includes a rotational shaft (hereinafter called as an "agitator shaft S2") oriented in the left-right direction and is capable of rotating about a central axis of the agitator shaft S2.

In the development chamber 27 are formed a supply-roller groove 30, a developing-roller-opposing surface 31, and a lower-film-adhering surface 32 as part of a top surface of a bottom wall 72 (described later).

The supply-roller groove 30 is formed in a general semicircular shape conforming to a circumferential surface of a supply roller 33 (described later), with the convex shape of the supply-roller groove 30 facing obliquely downward and rearward.

The developing-roller-opposing surface 31 is formed in a general arc shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. That is, the lower-film-adhering surface 32 is arranged higher than the developing-roller-opposing surface 31.

The lower-film-adhering surface 32 is also arranged to confront the bottom portion of the photosensitive drum 20 vertically, with a gap formed therebetween. The lower-film-adhering surface 32 is arranged to overlap the central axis of the photosensitive drum 20 when projected vertically.

The supply roller 33, the developing roller 34, a thickness-regulating blade 35, and a lower film 36 are provided in the development chamber 27. The supply roller 33 is an example of a supply member, and the developing roller 34 is an example of a developer carrier.

The supply roller 33 is formed in a general columnar shape that is elongated in the left-right direction. The supply roller 33 is provided in a front region of the development chamber 27 with its bottom portion disposed in the supply-roller groove 30. The supply roller 33 includes a rotational shaft (hereinafter called as a "supply roller shaft S3") oriented in the left-right direction along a central axis of the supply roller 33 and is capable of rotating about the central axis of the supply roller shaft S3. With this configuration, the supply roller 33 is disposed to the rear side of the toner-accommodating chamber 26 and is arranged at the same approximate height as the toner-accommodating chamber 26 (slightly higher than the toner-accommodating chamber 26).

The developing roller 34 is formed in a general columnar shape that is elongated in the left-right direction. The developing roller 34 is provided in a rear region of the development chamber 27 such that its bottom circumferential surface opposes the developing-roller-opposing surface 31 yet remains separated therefrom in a top-down direction (vertical direction). The developing roller 34 is provided with a rotational shaft (hereinafter called as a "developing roller shaft S4") oriented in the left-right direction along a central axis of the developing roller 34 and is capable of rotating about the central axis of the developing roller shaft S4.

The developing roller 34 is also disposed to contact the upper rear side of the supply roller 33 and so that its upper and rear portions are exposed outside the development chamber 27 and contact the lower front side of the photosensitive drum 20. In other words, the developing roller 34 is arranged on the upper rear side of the supply roller 33 and the lower front side of the photosensitive drum 20. The central axes of the supply roller 33, developing roller 34, and photosensitive drum 20 are positioned on substantially the same line following a radial direction of the photosensitive drum 20.

The developing roller 34 is also disposed in a position separated from the scorotron charger 22 in the circumferential direction of the photosensitive drum 20 and is arranged such that a virtual line segment (not shown) connecting the central axis of the photosensitive drum 20 to the charging wire 23 forms an angle of approximately 120° with a virtual line segment (not shown) connecting the central axis of the photosensitive drum 20 to the central axis of the developing roller 34. Hence, the developing roller 34, scorotron charger 22, and transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from the front side thereof.

The lower film 36 has a rear portion fixed to the lower-film-adhering surface 32. A front edge of the lower film 36 contacts the circumferential surface of the developing roller 34 above the developing-roller-opposing surface 31.

(3-2) Scanning Unit

The scanning unit 16 is arranged frontward of the process cartridge 15 to oppose but be separated from the photosensitive drum 20 in the front-rear direction.

The scanning unit 16 irradiates a laser beam L toward the photosensitive drum 20 based on image data, thereby exposing the circumferential surface of the photosensitive drum 20.

More specifically, the scanning unit 16 irradiates the laser beam L rearward to expose the circumferential surface of the photosensitive drum 20 on the front side thereof. In other words, the exposure point at which the photosensitive drum 20 is exposed to light (the circumferential surface on the front side of the photosensitive drum 20) is configured to be on a side opposite to a nip part at which the photosensitive drum 20 and transfer roller 21 contact each other with respect to the central axis of the photosensitive drum 20.

At this time, the developing cartridge 19 is arranged beneath an irradiation path of the laser beam L, while the scorotron charger 22 is disposed above the irradiation path of the laser beam L.

Guide parts 37 are provided on inner surfaces of the main casing 2 opposing the space between the scanning unit 16 and photosensitive drum 20 for guiding mounting and removal of the process cartridge 15. When removing the process cartridge 15 from the main casing 2, the guide parts 37 guide the process cartridge 15 so that the developing cartridge 19 mounted in the drum cartridge 18 moves upward, passing through the irradiation path of the laser beam L.

At this time, the various rollers provided in the process cartridge 15 (the transfer roller 21, supply roller 33, and developing roller 34) also pass upward through the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively tribo-charged between the supply roller 33 and developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20, forming an electrostatic latent image on the circumferential surface of the photosensitive drum 20 based on image data. Next, the toner carried on the developing roller 34 is supplied to the latent image on the circumferential surface of the photosensitive drum 20 so that a toner image (developer image) is carried on the circumferential surface of the photosensitive drum 20.

The rotating pickup roller 11 supplies the sheets S stacked on the sheet-supporting part 9 between the feeding roller 12 and feeding pad 13, and the rotating feeding roller 12 separates the sheets S, conveys each separated sheet S onto the feeding path 14, and supplies the sheets S one at a time to the image-forming unit 4 (between the photosensitive drum 20 and transfer roller 21) at a prescribed timing.

The sheet S is conveyed upward between the photosensitive drum 20 and transfer roller 21, at which time the toner image is transferred from the photosensitive drum 20 onto the sheet S, forming an image on the sheet S.

Next, the sheet S passes between the heating roller 38 and pressure roller 39. At this time, the heating roller 38 and pressure roller 39 apply heat and pressure to the sheet S to thermally fix the image to the sheet S.

The sheet S is subsequently conveyed toward discharge rollers 40. The discharge rollers 40 discharge the sheet S onto a discharge tray 41 formed on a top surface of the main casing 2.

In this way, the sheet S is supplied from the sheet-supporting part 9 and conveyed along a conveying path that has a general C-shape in a side view, passing first between the photosensitive drum 20 and transfer roller 21 (nip part) and next between the heating roller 38 and pressure roller 39, and subsequently being discharged onto the discharge tray 41.

2. Drum Cartridge

Figure 2:
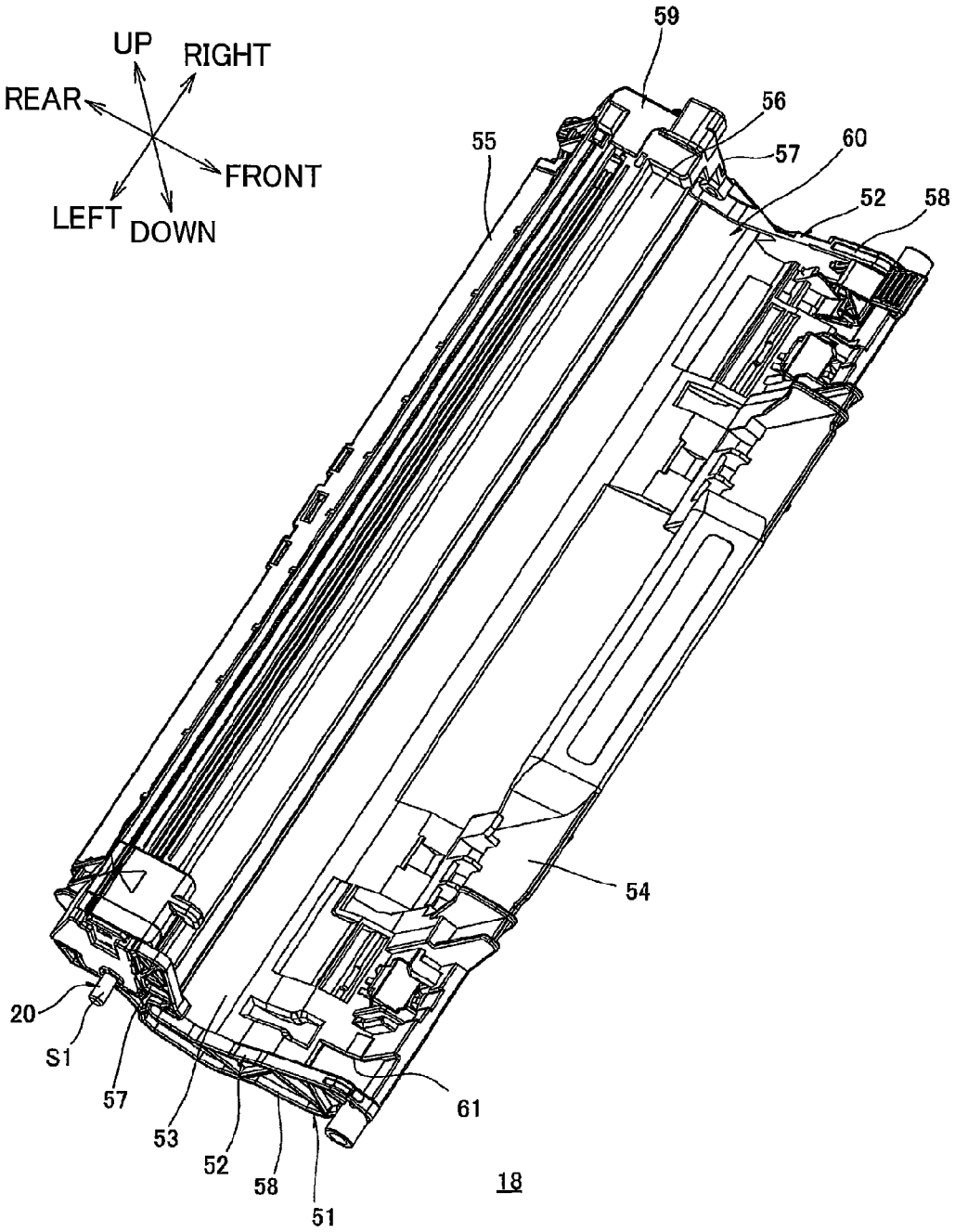
FIG. 2 is a perspective view of a drum cartridge shown in FIG. 1 as viewed from its upper-left side.

As shown in FIG. 2, the drum cartridge 18 includes a drum-cartridge frame 51.

In the following description of the drum cartridge 18, directions will be given under an assumption that the side of the drum cartridge 18 in which the photosensitive drum 20 is provided is the rear side, and the side in which the scorotron charger 22 is provided is the top. That is, up, down, front, and rear directions related to the drum cartridge 18 (directions in FIG. 2) differ slightly from the up, down, front, and rear directions related to the printer 1 (directions in FIGS. 1 and 11 through 13). When the drum cartridge 18 is mounted in the printer 1, the rear side of the drum cartridge 18 faces the upper rear side of the printer 1, and the front side of the drum cartridge 18 faces the lower front side of the printer 1.

The drum-cartridge frame 51 is provided with a pair of left and right side walls 52, a bottom wall 53, a front wall 54, a rear wall 55, and a top wall 56.

Each of the side walls 52 is formed in a general plate shape that is elongated in the front-rear direction. Each side wall 52 is integrally provided with a rear part 57 constituting the rear half of the side wall 52, and a front part 58 constituting the front half.

The rear part 57 is formed in a general rectangular shape in a side view and is elongated vertically.

The front part 58 is formed in a rectangular shape in a side view and extends continuously forward from a front edge on a lower portion of the rear part 57.

The bottom wall 53 is formed in a general plate shape that extends in the front-rear and left-right directions. The bottom wall 53 bridges bottom edges of the side walls 52.

The front wall 54 is formed in a general plate shape and extends continuously upward from a front edge of the bottom wall 53. The front wall 54 bridges front edges of the side walls 52.

The rear wall 55 bridges rear edges of the side walls 52. The rear wall 55 is formed in a general plate shape, and extends continuously upward from a rear edge of the bottom wall 53 and then bends in a direction sloping forward toward the top. The transfer roller 21 described above is rotatably supported to the inside (forward of) the rear wall 55.

The top wall 56 is disposed on the top of the drum-cartridge frame 51. The top wall 56 is formed in a general plate shape that extends forward from a top edge of the rear wall 55. The scorotron charger 22 described above is supported to the inside of (beneath) the top wall 56.

In this drum cartridge 18, a rear portion of the bottom wall 53, the rear wall 55, the top wall 56, and the rear parts 57 of the side walls 52 define a drum-accommodating section 59 that accommodates the photosensitive drum 20.

The photosensitive drum 20 is rotatably supported in the rear parts 57 of the side walls 52 at the corresponding left and right ends of the drum shaft S1. Note that the left and right ends of the drum shaft S1 penetrate the rear parts 57 of the respective side walls 52 and protrude outward respectively in the left-right direction.

Further, the bottom wall 53, front wall 54, and front parts 58 of the side walls 52 in the drum cartridge 18 define a cartridge-mounting section 60 in which the developing cartridge 19 is mounted. A detectable-gear exposure opening 61 is formed in the cartridge-mounting section 60.

The detectable-gear exposure opening 61 is formed in a lower front region of the drum-cartridge frame 51 at the left edge thereof. The detectable-gear exposure opening 61 penetrates a region extending across the front edge of the bottom wall 53 and the bottom edge of the front wall 54, forming a general rectangular shape in a plan view that is elongated in the front-rear direction.

3. Developing Cartridge

Figure 3:
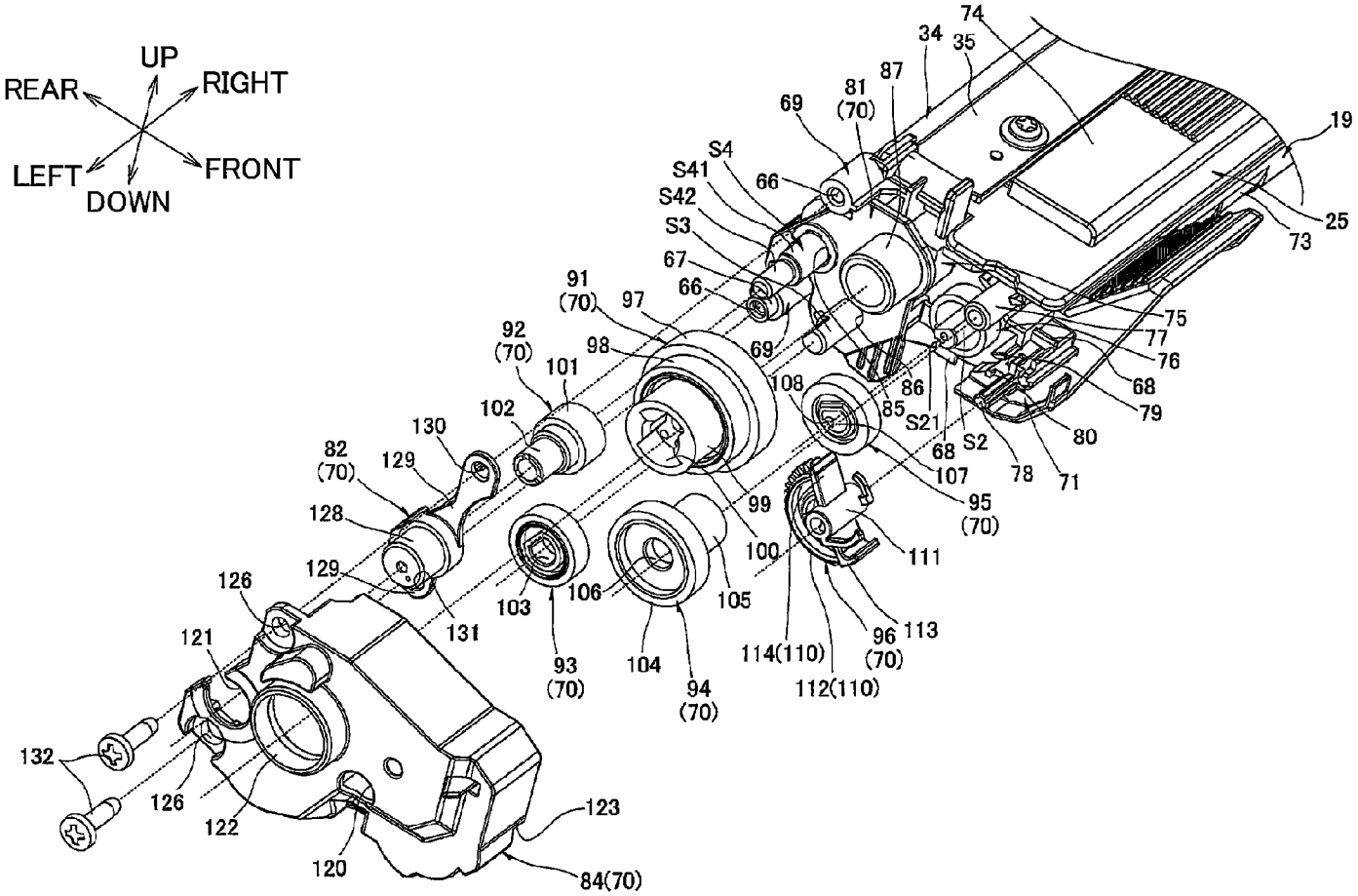
FIG. 3 is an exploded perspective view of a developing cartridge shown in FIG. 1 as viewed from its front-left side.

As shown in FIG. 3, the developing cartridge 19 includes the developing-cartridge frame 25 described above, and a drive unit 70 arranged on the left side of the developing-cartridge frame 25. A power supply unit (not shown) is provided on the right side of the developing-cartridge frame 25 for supplying power to the developing cartridge 19.

In the following description of the developing cartridge 19, directions related to the developing cartridge 19 will be given under an assumption that the side of the developing cartridge 19 in which the developing roller 34 is provided is the rear side, and the side in which the thickness-regulating blade 35 is provided is the top. That is, up, down, front, and rear directions related to the developing cartridge 19 (directions in FIGS. 3 through 10) differ slightly from the up, down, front, and rear directions related to the printer 1 (directions in FIGS. 1 and 11 through 13). When the developing cartridge 19 is mounted in the printer 1, the rear side of the developing cartridge 19 faces the upper rear side of the printer 1, and the front side of the developing cartridge 19 faces the lower front side of the printer 1.

(1) Developing-Cartridge Frame

The developing-cartridge frame 25 is formed in a box-like shape that is elongated in the left-right direction. More specifically, the developing-cartridge frame 25 includes a pair of left and right side walls 71, the bottom wall 72, a front wall 73, and a top wall 74. The side walls 71 are disposed apart from each other in the left-right direction, with one on either side of the toner-accommodating chamber 26. Below, a detailed description of the left side wall 71 that supports the drive unit 70 will be given while a description of the right side wall 71 will be omitted. Further, the left side wall 71 will simply be called the side wall 71.

The side wall 71 is formed in a general rectangular shape in a side view and is elongated in the front-rear direction. Formed on the side wall 71 are a seal-accommodating part 75, an agitator-shaft exposure part 76, an idle-gear support part 77, and a detectable-gear support part 78.

The seal-accommodating part 75 is formed in a general cylindrical shape that is closed on the left end. The seal-accommodating part 75 protrudes leftward from a left surface of the side wall 71 on the rear side of the side wall 71 at a position aligned with the development chamber 27. A developing-roller-shaft exposure hole (not shown) that exposes the left end of the developing roller shaft S4 and a supply-roller-shaft exposure hole (not shown) that exposes the left end of the supply roller shaft S3 are formed in a left wall of the seal-accommodating part 75, penetrating the left wall. A sealing member (not shown) is provided in the supply-roller-shaft exposure hole (not shown) for sealing a gap between the outer peripheral surface of the supply roller shaft S3 and an inner peripheral surface of the supply-roller-shaft exposure hole (not shown).

A gear fitting part S41 and a collar fitting part S42 are provided on the left end of the developing roller shaft S4 that is exposed on the left side of the seal-accommodating part 75.

The gear fitting part S41 is formed with a general D-shaped cross section.

The collar fitting part S42 extends leftward from a left endface of the gear fitting part S41. The collar fitting part S42 is formed in a general columnar shape with a smaller diameter than the gear fitting part S41.

The left end of the supply roller shaft S3 exposed on the left side of the seal-accommodating part 75 is formed with a general D-shaped cross section.

The agitator-shaft exposure part 76 is formed in a general cylindrical shape in a side view and is positioned on the front side of the seal-accommodating part 75.

Figure 9:
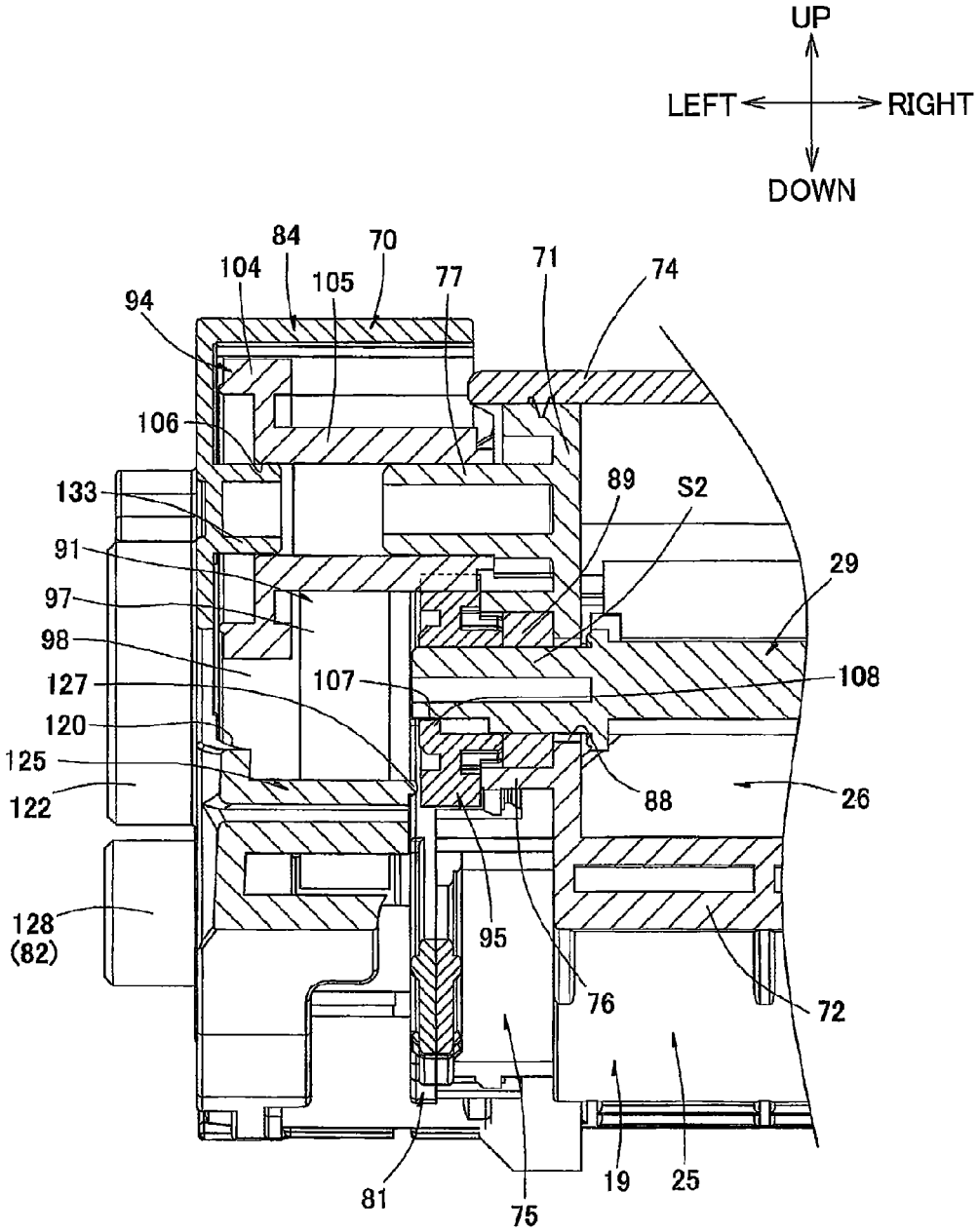
FIG. 9 is a cross-sectional view of the developing cartridge shown in FIG. 7 taken along a plane A-A.

As shown in FIG. 9, an agitator-shaft insertion hole 88 penetrates the side wall 71 at a position within the agitator-shaft exposure part 76. An agitator-shaft seal 89 is also provided inside the agitator-shaft exposure part 76 on the left side of the side wall 71.

The agitator-shaft insertion hole 88 is formed in a general circular shape in a side view. The agitator-shaft insertion hole 88 has a larger inner diameter than an outer diameter of the agitator shaft S2 at the left and right ends thereof. The left end of the agitator shaft S2 passes through the agitator-shaft insertion hole 88 and is exposed on the left side of the side wall 71.

The left end of the agitator shaft S2 exposed on the left side of the agitator-shaft insertion hole 88 is formed with a general D-shaped cross section. A recess S21 is formed in the left surface of the agitator shaft S2 exposed on the left side of the agitator-shaft insertion hole 88. The recess S21 is formed in a general semicircular shape in a side view and is recessed radially inward from the circumferential surface of the agitator shaft S2.

The agitator-shaft seal 89 is formed of a sponge or other elastic material having a general annular shape with substantial thickness in the left-right dimension. The agitator-shaft seal 89 is fitted inside the agitator-shaft exposure part 76 to be fitted around the agitator shaft S2 on the right side of the generally D-shaped cross-sectional part (fitted over the agitator shaft S2 from the radial outer side thereof).

As shown in FIG. 3, the idle-gear support part 77 is formed in a general columnar shape. The idle-gear support part 77 protrudes leftward from the left surface of the side wall 71 at a position above and frontward of the agitator-shaft exposure part 76.

The detectable-gear support part 78 is formed in a columnar shape that is generally plus-sign-shaped in a side view. The detectable-gear support part 78 protrudes leftward from the left surface of the side wall 71 at a position below and frontward of the idle-gear support part 77. The detectable-gear support part 78 protrudes farther leftward than the idle-gear support part 77.

The side wall 71 is also provided with a plurality (2 in the present embodiment) of engageable parts 68, and a plurality (2 in the present embodiment) of threaded parts 69.

Figure 5:
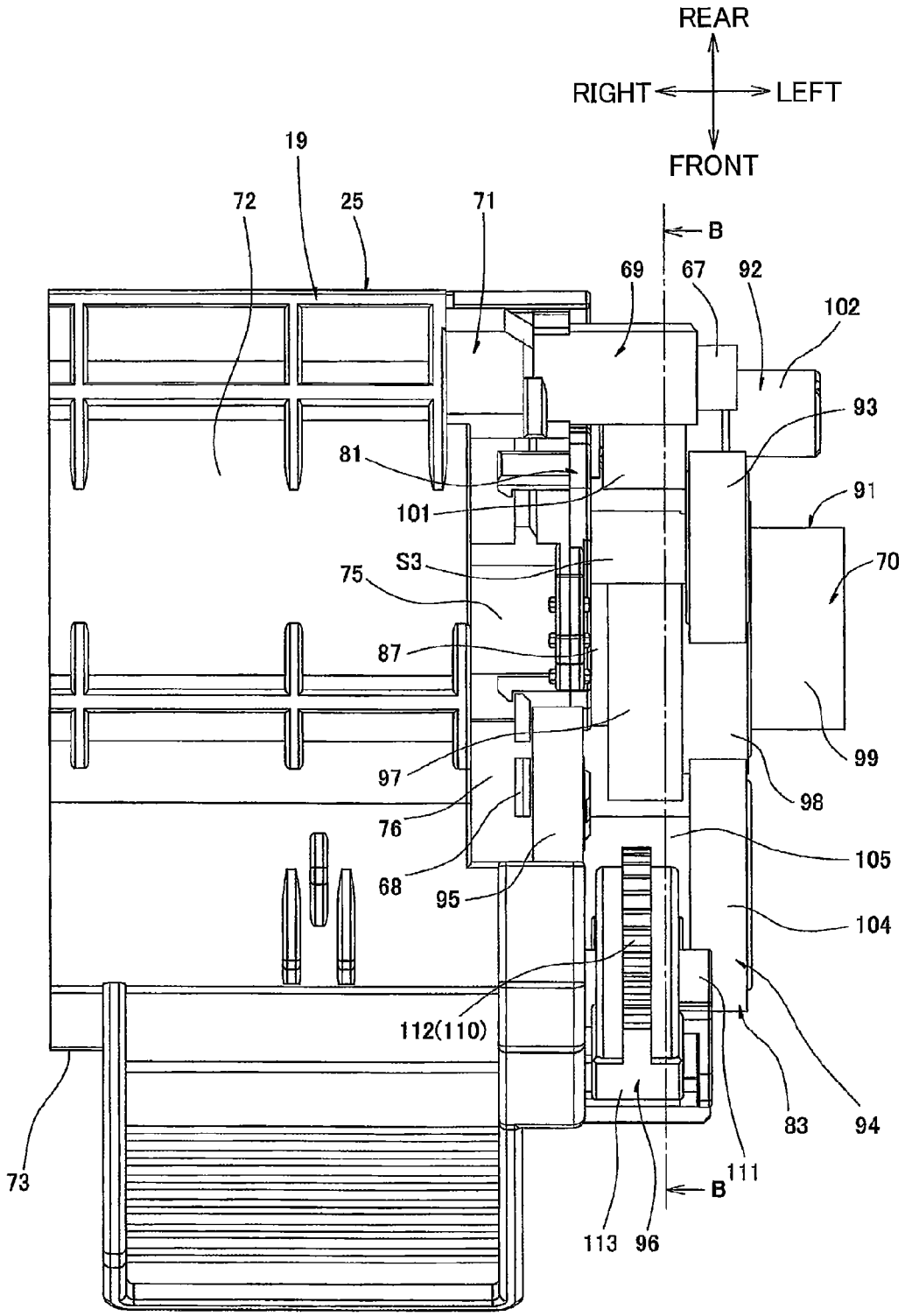
FIG. 5 is a bottom view of the developing cartridge shown in FIG. 4.

One of the engageable parts 68 is provided above the detectable-gear support part 78, and the other is provided below the agitator-shaft exposure part 76 (see FIG. 5).

The upper engageable part 68 protrudes leftward from the left surface of the side wall 71 above the detectable-gear support part 78. The left end of the upper engageable part 68 bends upward to form a hook-like shape.

The lower engageable part 68 protrudes downward from a bottom surface of the agitator-shaft exposure part 76 on the left end thereof. The lower engageable part 68 has a ridge-like shape that extends in the front-rear direction (see FIGS. 5 and 8).

One of the threaded parts 69 is provided in an upper rear corner of the side wall 71, and the other is provided in a lower rear corner of the side wall 71. Each threaded part 69 has a general columnar shape and protrudes leftward from the left surface of the side wall 71. A screw hole 66 is formed in each threaded part 69 as a rightward recess in a left surface thereof. Further, a reduced-diameter part 67 is formed on the lower threaded part 69.

The reduced-diameter part 67 is formed in a general cylindrical shape on the left endface of the lower threaded part 69. The reduced-diameter part 67 extends leftward from a peripheral edge of the screw hole 66. The reduced-diameter part 67 has an outer diameter smaller than the outer diameter of a portion of the threaded part 69 right of the reduced-diameter part 67.

The bottom wall 72 is formed in a general plate shape that is elongated in the front-rear direction. The left and right edges of the bottom wall 72 are formed continuously with the bottom edges of the side walls 71 (see FIG. 4).

The front wall 73 is formed in a general plate shape that extends continuously upward from the front edge of the bottom wall 72. Left and right edges of the front wall 73 are formed continuously with the front edges of the side walls 71.

The top wall 74 is formed in a general plate shape that is elongated in the front-rear and left-right directions. The top wall 74 is disposed to confront the top edges of the side walls 71 and front wall 73 from above. Peripheral edges of the top wall 74 are fixed to the top edges of the side walls 71 and front wall 73 through a method such as welding.

(2) Drive Unit

The drive unit 70 includes a bearing member 81, a gear train 83 (see FIG. 4), a collar member 82, and a gear cover 84 as an example of a cover member.

(2-1) Bearing Member

The bearing member 81 is supported to the developing-cartridge frame 25 on the left side of the seal-accommodating part 75. The bearing member 81 is formed in a general plate shape that extends vertically. Formed in the bearing member 81 are a developing-roller-shaft insertion hole 85, and a supply-roller-shaft insertion hole 86. The bearing member 81 further includes a coupling support part 87.

The developing-roller-shaft insertion hole 85 is formed with a general circular shape in a side view and penetrates a rear portion of the bearing member 81. The developing-roller-shaft insertion hole 85 has an inner diameter approximately equal to (slightly larger than) the outer diameter of the developing roller shaft S4.

The supply-roller-shaft insertion hole 86 is formed with a general circular shape in a side view and penetrates a portion of the bearing member 81 at a position below and forward of the developing-roller-shaft insertion hole 85. The supply-roller-shaft insertion hole 86 has an inner diameter approximately equal to (slightly larger than) the outer diameter of the supply roller shaft S3.

The coupling support part 87 is formed in a general columnar shape at a position forward of the developing-roller-shaft insertion hole 85 and above the supply-roller-shaft insertion hole 86. The coupling support part 87 protrudes leftward from a left surface of the bearing member 81.

(2-2) Gear Train

Figure 4:
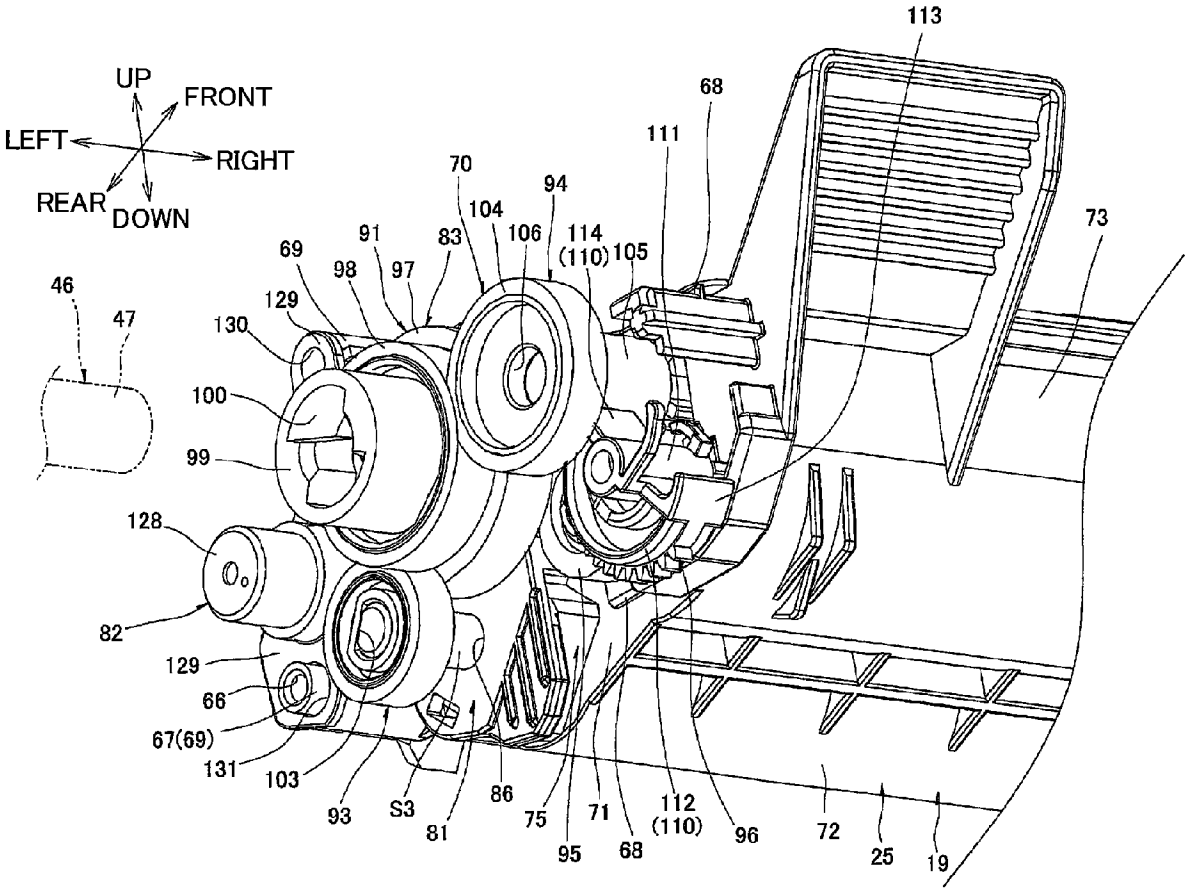
FIG. 4 is a perspective view of the developing cartridge shown in FIG. 1 as viewed from its front-left side, wherein a gear cover is removed.

As shown in FIGS. 3 and 4, the gear train 83 includes a development coupling 91 as an example of a receiving member, a development gear 92 as an example of a third drive-force transmission member, a supply gear 93 as an example of a fourth drive-force transmission member, an idle gear 94 as an example of a first drive-force transmission member, an agitator gear 95 as an example of a second drive-force transmission member, and a detectable gear 96 as an example of a detected member.

The development coupling 91 is formed in a general columnar shape that is elongated in the left-right direction. The development coupling 91 integrally includes a large-diameter gear part 97, a small-diameter gear part 98, and a coupling part 99. The large-diameter gear part 97 is an example of a first gear part and the small-diameter gear part 98 is an example of a second gear part.

The large-diameter gear part 97 is formed in a general disc shape having a substantial thickness in the left-right dimension. The large-diameter gear part 97 constitutes a right end of the development coupling 91. A through-hole (not shown) having a diameter greater than (substantially equal to) the outer diameter of the coupling support part 87 is formed in a radial center of the large-diameter gear part 97. Gear teeth are formed around an entire circumferential surface of the large-diameter gear part 97.

The small-diameter gear part 98 is formed in a general columnar shape and protrudes leftward from a left surface of the large-diameter gear part 97 so as to surround the through-hole (not shown) of the large-diameter gear part 97. The small-diameter gear part 98 has an outer diameter smaller than the outer diameter of the large-diameter gear part 97. The small-diameter gear part 98 has an inner diameter larger than the through-hole (not shown) formed in the large-diameter gear part 97. Further, the small-diameter gear part 98 has a central axis coincident with a central axis of the large-diameter gear part 97. Gear teeth are formed around an entire circumferential surface of the small-diameter gear part 98. The number of teeth formed on the small-diameter gear part 98 is fewer than the number of teeth on the large-diameter gear part 97.

The coupling part 99 is disposed on the radial inside of the small-diameter gear part 98. The coupling part 99 is formed continuously with the left surface of the large-diameter gear part 97 and has a general cylindrical shape that is closed on the left end. The coupling part 99 protrudes leftward from a peripheral edge of the through-hole (not shown) formed in the large-diameter gear part 97. The coupling part 99 has an outer diameter smaller than the inner diameter of the small-diameter gear part 98. The coupling part 99 has an inner diameter that is equivalent to the inner diameter of the through-hole (not shown) of the large-diameter gear part 97. The central axis of the coupling part 99 is coincident with the central axis of the large-diameter gear part 97. A coupling recess 100 is also formed in a left surface of the coupling part 99.

The coupling recess 100 is formed in a general shape of an elongate hole in a side view that is elongated in a radial direction of the development coupling 91. The coupling recess 100 is recessed rightward from the left surface of the development coupling 91. A coupling protrusion 47 (see FIG. 4) of a main coupling 46 (see FIG. 4) provided in the main casing 2 is fitted into the coupling recess 100 for transmitting a drive force.

The development gear 92 is formed in a general cylindrical shape that is elongated in the left-right direction. The development gear 92 integrally possesses a gear part 101, and a collar insertion part 102.

The gear part 101 constitutes a right end of the development gear 92. The gear part 101 is formed in a general disc shape with a substantial thickness in the left-right direction. A through-hole (not shown) is formed in a radial center of the gear part 101. The through-hole has a general D-shape in a side view and can receive the left end of the developing roller shaft S4. Gear teeth are formed around an entire circumferential surface of the gear part 101.

The collar insertion part 102 is formed in a general cylindrical shape and protrudes continuously leftward from a left end of the gear part 101. The collar insertion part 102 has an outer diameter smaller than the outer diameter of the gear part 101. The central axis of the collar insertion part 102 is coincident with the central axis of the gear part 101.

The supply gear 93 is formed in a general disc shape having a substantial thickness in the left-right direction. A supply-roller-shaft fitting hole 103 is formed in the supply gear 93 to penetrate a radial center thereof. The supply-roller-shaft fitting hole 103 has a general D-shape in a side view and can receive the left end of the supply roller shaft S3. Gear teeth extending in the left-right direction are formed around an entire circumferential surface of the supply gear 93.

The idle gear 94 is formed in a general cylindrical shape that is elongated in the left-right direction. The idle gear 94 integrally possesses a large-diameter part 104, and a small-diameter part 105. The large-diameter part 104 is an example of a first portion, and the small-diameter part 105 is an example of a second portion.

The large-diameter part 104 constitutes a left end portion of the idle gear 94. The large-diameter part 104 is formed in a general disc shape having a substantial thickness in the left-right direction. A fitting hole 106 penetrates a radial center of the large-diameter part 104. The fitting hole 106 is formed in a general circular shape in a side view. The large-diameter part 104 has an outer diameter smaller than the outer diameter of the small-diameter gear part 98 of the development coupling 91. Gear teeth are formed around an entire peripheral surface of the large-diameter part 104. The number of teeth formed on the large-diameter part 104 is fewer than the number formed on the small-diameter gear part 98 of the development coupling 91.

The small-diameter part 105 is formed on a right endface of the large-diameter part 104 and has a general cylindrical shape that extends rightward from the peripheral edge of the fitting hole 106. The outer diameter of the small-diameter part 105 is smaller than the outer diameter of the large-diameter part 104. The small-diameter part 105 shares a central axis with the large-diameter part 104. Gear teeth are formed around an entire peripheral surface of the small-diameter part 105. The number of teeth formed on the small-diameter part 105 is fewer than the number of teeth on the large-diameter part 104.

The agitator gear 95 is formed in a general disc shape having a substantial thickness in the left-right direction. An agitator-shaft fitting hole 107 penetrates a radial center of the agitator gear 95. The agitator-shaft fitting hole 107 is formed with a general D-shape in a side view and can receive the left end of the agitator shaft S2. The agitator-shaft fitting hole 107 is an example of a fitting hole. Gear teeth are formed around an entire circumferential surface of the agitator gear 95. A protrusion 108 is also provided in the agitator-shaft fitting hole 107 formed in the agitator gear 95. The protrusion 108 is an example of a protruding portion.

The protrusion 108 is formed at a left end of the agitator-shaft fitting hole 107. The protrusion 108 has a general semicircular shape in a side view and protrudes inward from an inner circumferential surface of the agitator-shaft fitting hole 107 (inward in a radial direction of the agitator-shaft fitting hole 107). The protrusion 108 is positioned so as not to overlap with a symmetrical axis V (see a phantom line in FIG. 7) of the agitator-shaft fitting hole 107 (having a general D-shaped side view) in a side view. The outer diameter of the protrusion 108 is smaller than the inner diameter of the recess S21 formed in the agitator shaft S2.

Figure 10:
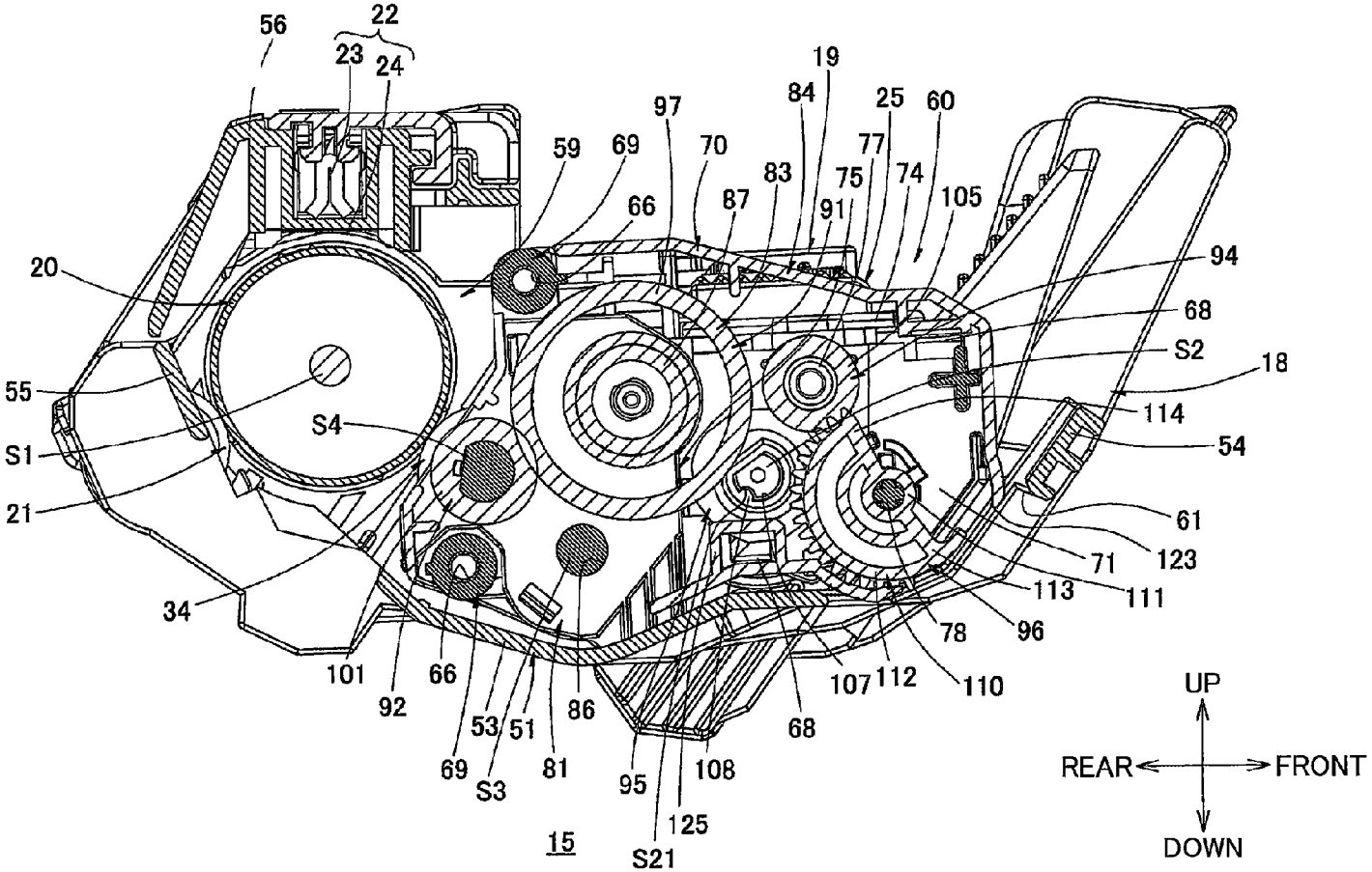
FIG. 10 is a cross-sectional view of a process cartridge shown in FIG. 1 taken along a plane B-B shown in FIG. 5.

The detectable gear 96 is formed in a general semicircular disc shape having a substantial thickness in the left-right direction. More specifically, as shown in FIGS. 3 and 10, the detectable gear 96 includes a shaft part 111, a toothed part 112, a first contact part 113, and a second contact part 114.

The shaft part 111 is disposed in a radial center of the detectable gear 96. The shaft part 111 is formed in a general cylindrical shape that is elongated in the left-right direction. The shaft part 111 has an inner diameter larger than (approximately equal to) the outer diameter of the detectable-gear support part 78.

The toothed part 112 forms an outer shape of the detectable gear 96. The toothed part 112 is formed in a general semicylindrical disc shape having a substantial thickness in the left-right direction. The left-right dimension of the toothed part 112 is smaller than the left-right dimension of the shaft part 111. Gear teeth extending in the left-right direction are formed on a circumferential surface of the toothed part 112.

The first contact part 113 is formed on an upstream edge of the toothed part 112 and continues upstream therefrom in a clockwise direction in a left side view. The first contact part 113 is formed in a general plate shape that extends first radially outward from the shaft part 111 (i.e., outward in a radial direction of the detectable gear 96; hereinafter it should be assumed that a radial direction of the shaft part 111 is the radial direction of the detectable gear 96), and then bends upstream in the clockwise direction in a left side view. The left-right dimension of the first contact part 113 is greater than the left-right dimension of the toothed part 112 but smaller than the left-right dimension of the shaft part 111.

The second contact part 114 is formed on a downstream edge of the toothed part 112 and continues downstream therefrom in the clockwise direction in a left side view. The second contact part 114 is formed in a general plate shape that extends radially outward from the shaft part 111. A gear tooth extending in the left-right direction is also formed on an outer radial edge of the second contact part 114 so as to continue the sequence of the gear teeth formed on the toothed part 112. The left-right dimension of the second contact part 114 is equal to the left-right dimension of the first contact part 113.

(2-3) Assembled State of the Gear Train

As shown in FIGS. 3 and 4, the development coupling 91 is rotatably supported on the coupling support part 87 of the bearing member 81. The development coupling 91 is rotatable about a central axis A1 (see FIG. 11) of the coupling support part 87.

The development gear 92 is disposed on the left side of the bearing member 81 and is fitted over the left end of the developing roller shaft S4 (fitted around the radial outside of the developing roller shaft S4) so as to be incapable of rotating relative to the developing roller shaft S4 by fitting the gear fitting part S41 of the developing roller shaft S4 in a fitting hole (not shown) formed in the gear part 101 and by fitting the collar fitting part S42 of the developing roller shaft S4 into the collar insertion part 102. Thus, the development gear 92 is rotatable with the developing roller shaft S4 about a central axis A4 (see FIG. 11) of the developing roller shaft S4. The gear part 101 of the development gear 92 is engaged with the large-diameter gear part 97 of the development coupling 91 from the lower rear side thereof. That is, when projected in the left-right direction, the development gear 92 is overlapped with a rotational path of the large-diameter gear part 97 at a position where the development gear 92 engages the large-diameter gear part 97 (see FIG. 10).

The supply gear 93 is disposed on the left side of the bearing member 81 and is supported on the left end of the supply roller shaft S3 so as to be incapable of rotating relative to the supply roller shaft S3 by fitting the left end of the supply roller shaft S3 into the supply-roller-shaft fitting hole 103 of the supply gear 93. Thus, the supply gear 93 is rotatable about a central axis AS (refer to FIG. 11) of the supply roller shaft S3 together with the supply roller shaft S3. The supply gear 93 is spaced apart from the lower front side of the development gear 92 and is engaged with the small-diameter gear part 98 of the development coupling 91 from the lower rear side thereof. That is, when projected in the left-right direction, the supply gear 93 is overlapped with the large-diameter gear part 97 at a position where the supply gear 93 engages the small-diameter gear part 98 (see FIG. 11).

The idle gear 94 is rotatably supported on the idle-gear support part 77 of the developing-cartridge frame 25 at the small-diameter part 105. The idle gear 94 is rotatable about a central axis A2 (see FIG. 11) of the idle-gear support part 77. The large-diameter part 104 of the idle gear 94 is engaged with the small-diameter gear part 98 of the development coupling 91 from the front side thereof. That is, when projected in the left-right direction, the large-diameter part 104 of the idle gear 94 is overlapped with the large-diameter gear part 97 at a position where the large-diameter part 104 engages the small-diameter gear part 98 (see FIG. 11). Here, the small-diameter part 105 of the idle gear 94 is separated frontward from the large-diameter gear part 97 of the development coupling 91 (see FIG. 10).

Figure 11:
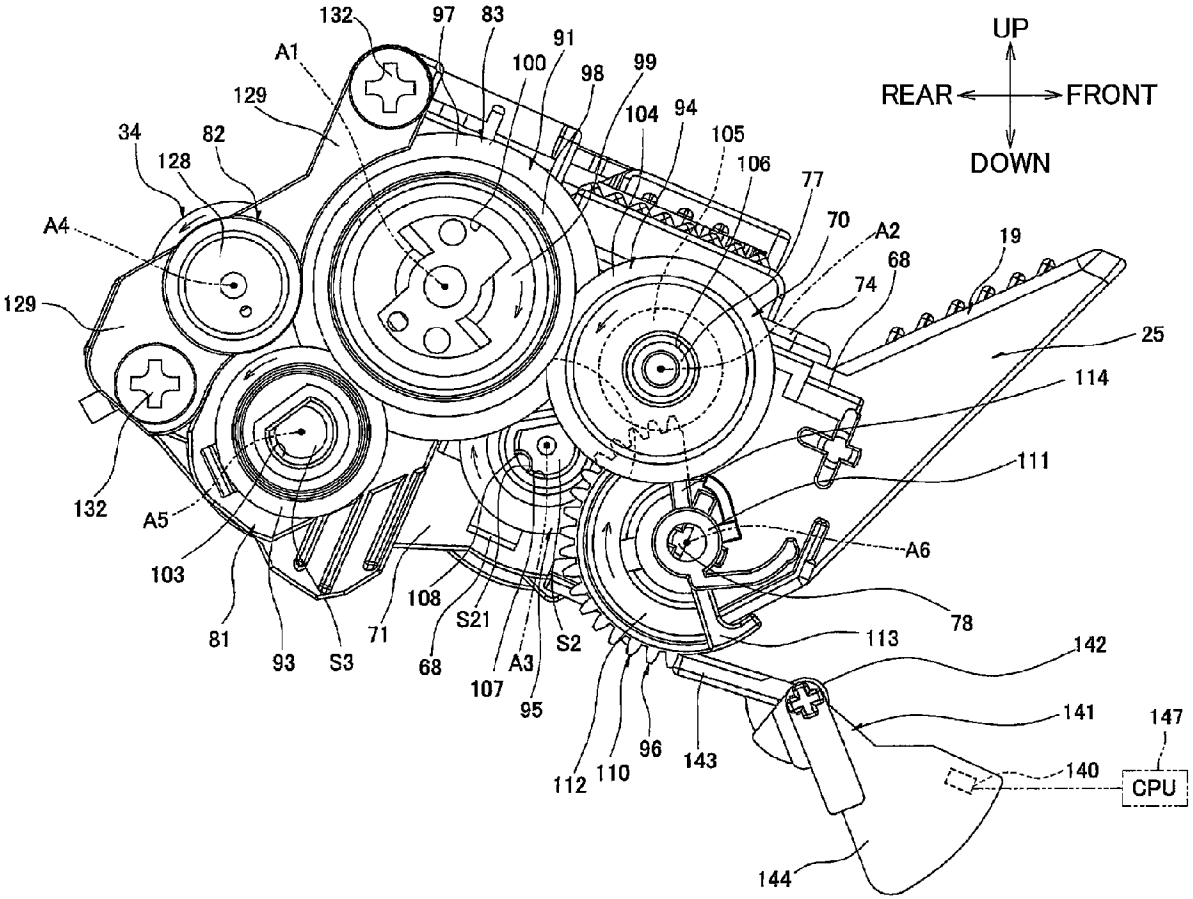
FIG. 11 is an explanatory view explaining a new product sensing operation of the developing cartridge, wherein a first contact part of a detectable gear is in abutment with an actuator to place the actuator in a detection position.

The agitator gear 95 is disposed on the left side of the left side wall 71 constituting the developing-cartridge frame 25 and on the right side of the development coupling 91, and is frontward of the seal-accommodating part 75 and rearward of the small-diameter part 105 constituting the idle gear 94 (see FIG. 10). The agitator gear 95 has a rear end portion that is overlapped with the large-diameter gear part 97 (see FIG. 10). The agitator gear 95 is supported on the left end of the agitator shaft S2 so as to be incapable of rotating relative to the agitator shaft S2 by fitting the left end of the agitator shaft S2 in the agitator-shaft fitting hole 107 of the agitator gear 95 and fitting the protrusion 108 into the recess S21 formed in the agitator shaft S2. The agitator gear 95 has a rotation center (the central axis A3 of the agitator shaft S2) that is closer to the rotation center of the development coupling 91 (the central axis A1 of the coupling support part 87) than the rotation center of the idle gear 94 (the central axis A2 of the idle-gear support part 77) is, as shown in FIG. 11. The agitator gear 95 is engaged with the right end portion of the small-diameter part 105 constituting the idle gear 94 from the lower rear side thereof (see FIG. 5).

The detectable gear 96 is rotatably supported on the detectable-gear support part 78 of the developing-cartridge frame 25. Hence, the detectable gear 96 can rotate about a central axis A6 of the detectable-gear support part 78 (see FIG. 11). The detectable gear 96 is engaged with the left end portion of the small-diameter part 105 constituting the idle gear 94 from the lower front side thereof through gear teeth formed on the second contact part 114 of the detectable gear 96 (see FIGS. 10 and 11). In other words, the detectable gear 96 is engaged with the small-diameter part 105 of the idle gear 94 at a position leftward of the agitator gear 95 and rightward of the large-diameter part 104 of the idle gear 94. The detectable gear 96 has an upper-front end portion that is overlapped with the large-diameter part 104 of the idle gear 94 when projected in the left-right direction (see FIG. 11).

(2-4) Collar Member

The collar member 82 is provided with a collar part 128, and a plurality (2 in the present embodiment) of fixing parts 129.

The collar part 128 is formed in a general cylindrical shape that is elongated in the left-right direction and closed on the left end. The collar part 128 has an inner diameter approximately equal to (slightly larger than) the outer diameter of the collar insertion part 102 constituting the development gear 92.

The fixing parts 129 are provided one above and the other below the collar part 128.

The upper fixing part 129 is formed in a general plate shape that extends continuously upward from a right end of the collar part 128. A screw insertion hole 130 is formed in the upper fixing part 129.

The screw insertion hole 130 is generally circular in a side view and is formed in an upper end portion of the upper fixing part 129.

The lower fixing part 129 is formed in a general plate shape that extends continuously downward from the right end of the collar part 128. A reduced-diameter-part insertion hole 131 is formed in the lower fixing part 129.

The reduced-diameter-part insertion hole 131 has a generally circular shape in a side view and is formed in a lower end portion of the lower fixing part 129. The reduced-diameter-part insertion hole 131 has an inner diameter larger than the outer diameter of the reduced-diameter part 67 constituting the lower threaded part 69.

The reduced-diameter-part insertion hole 131 is fitted around the reduced-diameter part 67 of the lower threaded part 69 (fitted over the outer radial side of the reduced-diameter part 67), and the collar part 128 is fitted around the collar insertion part 102 of the development gear 92 (fitted over the outer radial side of the collar insertion part 102) so as to be incapable of rotating relative to the collar insertion part 102.

In this state, the screw insertion hole 130 of the upper fixing part 129 is aligned with the screw hole 66 of the upper threaded part 69 in the left-right direction.

(2-5) Gear Cover

Figure 6:
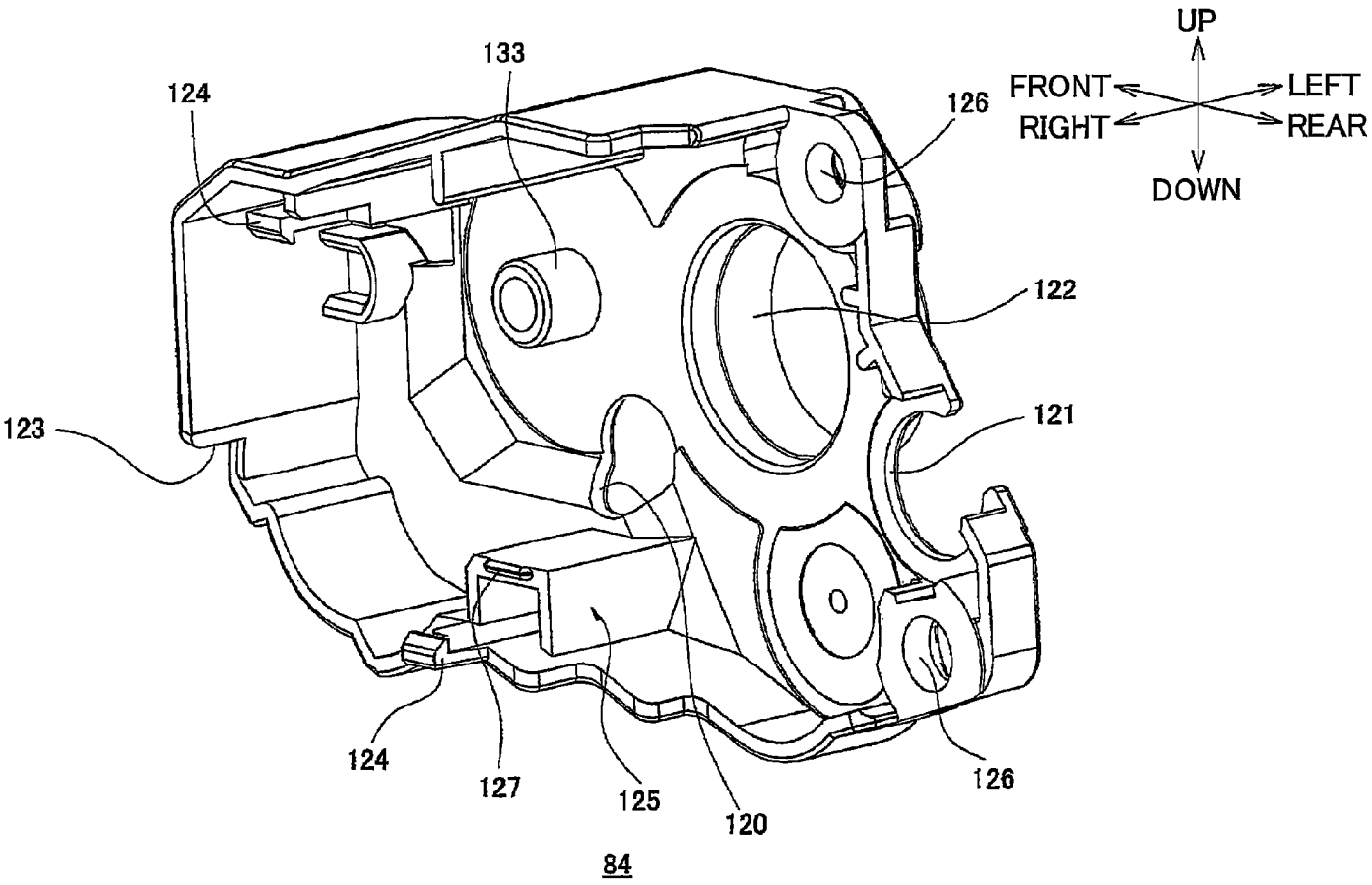
FIG. 6 is a perspective view of the gear cover shown in FIG. 3 as viewed from its rear-right side.

As shown in FIGS. 3 and 6, the gear cover 84 is formed in a general box-like shape having an open right side and a closed left side. Formed in the gear cover 84 are a collar exposure opening 121, a coupling collar 122, an agitator-gear exposure opening 120 and a detectable-gear exposure opening 123. The gear cover 84 is also provided with an agitator-gear-restricting part 125 and an idle-gear-supporting part 133.

The collar exposure opening 121 is formed in a rear edge of the gear cover 84 and has a general C-shape in a side view with the opening of the "C" facing obliquely upward and rearward so that the rear edge of the gear cover 84 is cut out in a direction obliquely downward and forward. The inner diameter of the collar exposure opening 121 is larger than the outer diameter of the collar member 82.

The coupling collar 122 is formed in a position diagonally above and forward of the collar exposure opening 121 and has a general cylindrical shape that extends leftward from a left wall of the gear cover 84. The right side of the coupling collar 122 is in communication with the interior (right side) of the gear cover 84.

The agitator-gear exposure opening 120 is a through-hole formed frontward of the coupling collar 122 and has a general circular shape in a side view.

The detectable-gear exposure opening 123 is formed in a lower-front end portion of a peripheral wall constituting the gear cover 84. The detectable-gear exposure opening 123 has a general rectangular shape in a front view so as to cut out from the inner left-right edge (right edge) of the gear cover 84 toward the outer left-right side (left side).

The agitator-gear-restricting part 125 is disposed below the agitator-gear exposure opening 120 and rearward of the detectable-gear exposure opening 123. The agitator-gear-restricting part 125 is formed in a general square columnar shape that protrudes rightward from an inner surface (right surface) of the left wall of the gear cover 84. A restricting protrusion 127 is provided on the agitator-gear-restricting part 125 as an example of an opposing part.

The restricting protrusion 127 is provided on a top edge of the agitator-gear-restricting part 125 and protrudes rightward from a right surface thereof. The restricting protrusion 127 is a ridge that extends in the front-rear direction.

The idle-gear-supporting part 133 is disposed obliquely above and forward of the agitator-gear-restricting part 125. The idle-gear-supporting part 133 is formed in a general circular columnar shape and protrudes rightward from the inner surface (right surface) on the left wall of the gear cover 84.

The gear cover 84 is also provided with a plurality (2 in the present embodiment) of anchoring pawls 124. A plurality (2 in the present embodiment) of screw insertion holes 126 is also formed in the gear cover 84.

The anchoring pawls 124 are provided one near an upper-front end portion and the other on a bottom end portion of the gear cover 84.

More specifically, the upper anchoring pawl 124 is provided on the inside (on the lower rear side) of the upper-front peripheral wall of the gear cover 84. The upper anchoring pawl 124 protrudes rightward from the inner surface (right surface) on the left wall of the gear cover 84. The right end of the upper anchoring pawl 124 has a hook-like shape that bends downward.

The lower anchoring pawl 124 (an example of an engaging part) is disposed below the agitator-gear-restricting part 125. The lower anchoring pawl 124 protrudes inward in the left-right direction (rightward) from the inner left-right edge (right edge) on the lower peripheral wall of the gear cover 84. The right end of the lower anchoring pawl 124 has a hook-like shape that bends upward.

One of the screw insertion holes 126 is formed in both upper-rear and lower-rear end portions of the gear cover 84. The screw insertion holes 126 have a general circular shape in a side view and penetrate the gear cover 84.

Figure 7:
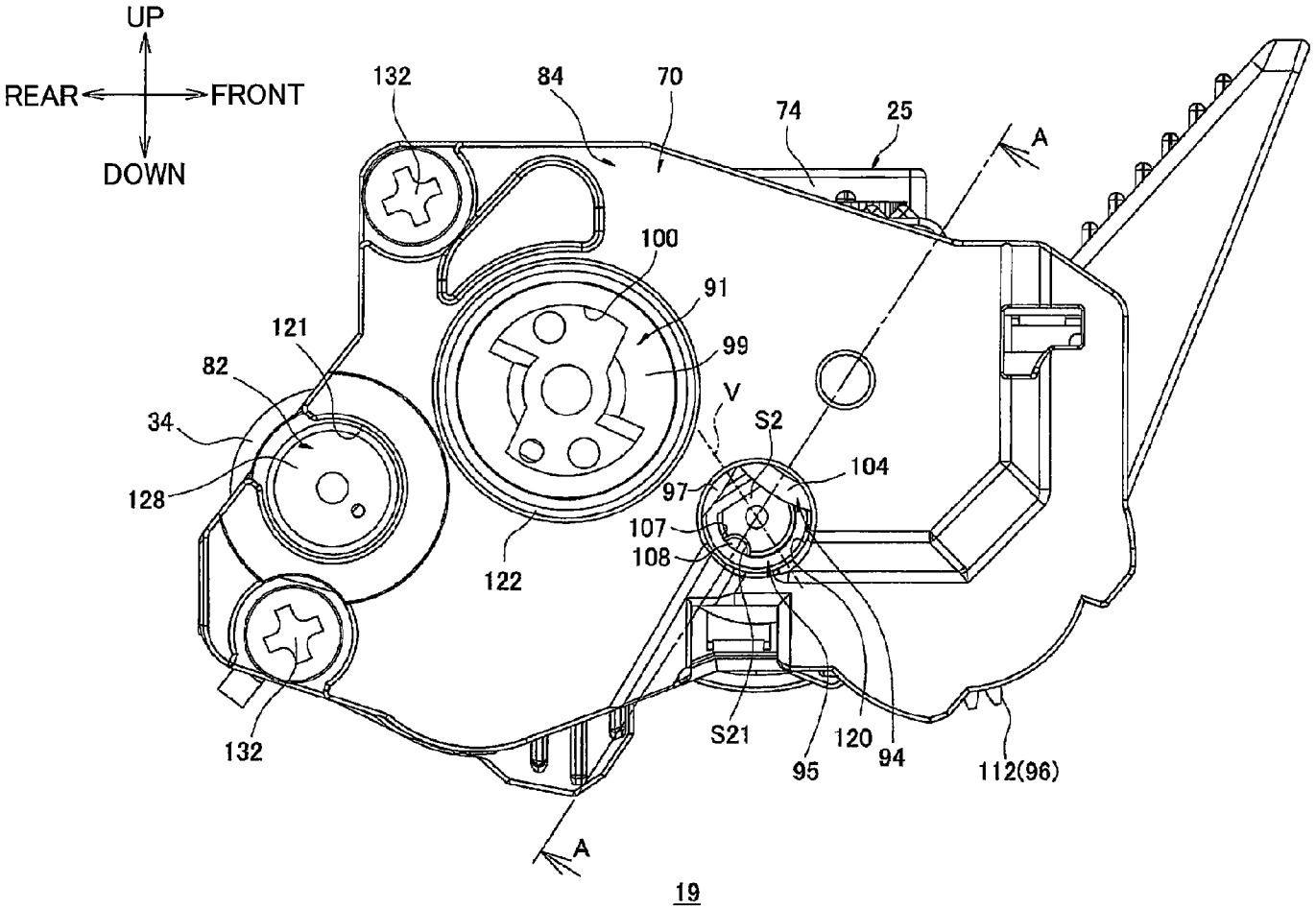
FIG. 7 is a left side view of the developing cartridge shown in FIG. 1.
Figure 8:
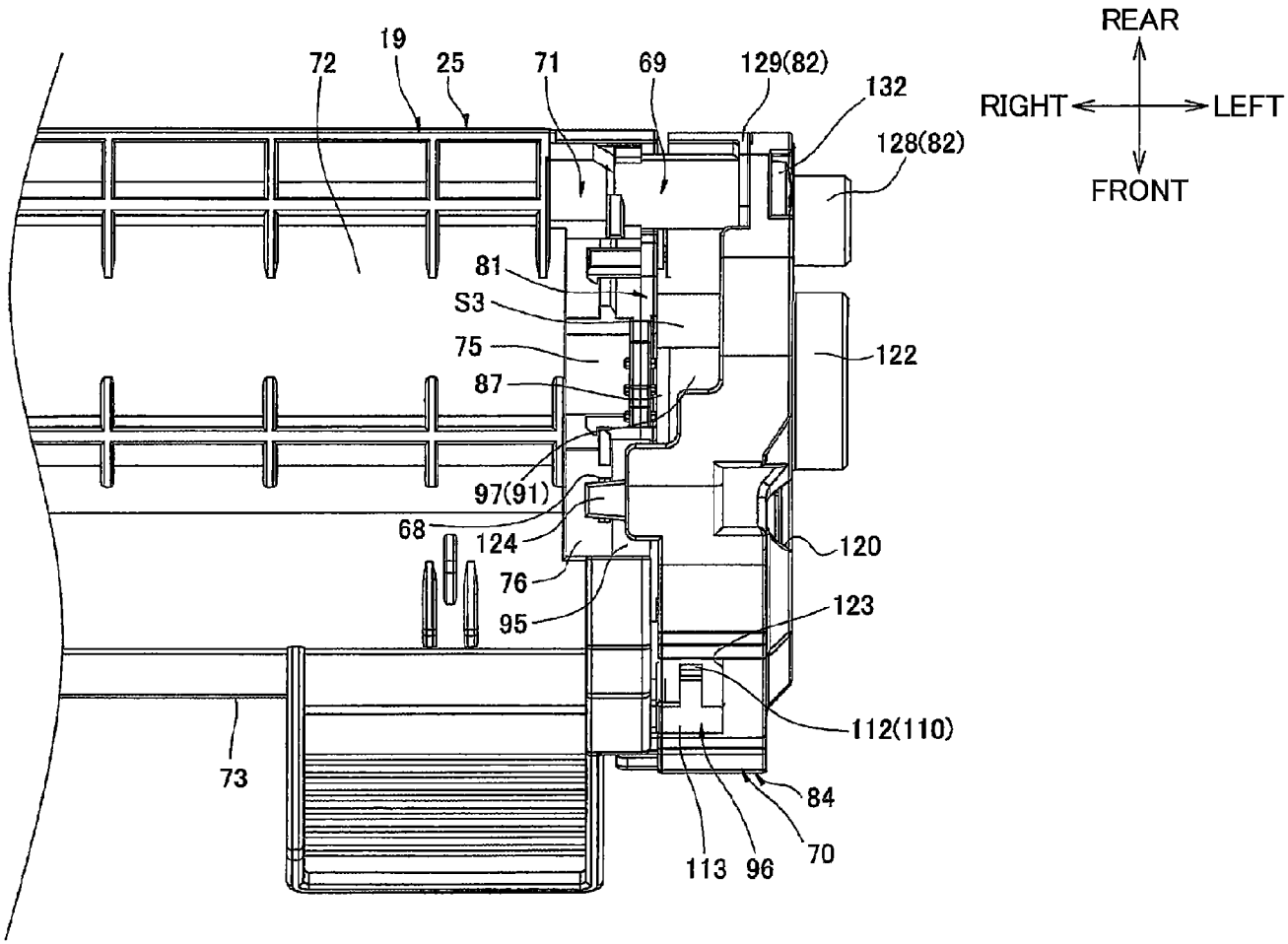
FIG. 8 is a bottom view of the developing cartridge shown in FIG. 7.

As shown in FIGS. 7 and 8, the gear cover 84 covers the gear train 83 with the collar part 128 of the collar member 82 inserted into the collar exposure opening 121 and the left end portion of the development coupling 91 inserted into the coupling collar 122.

In this state, the restricting protrusion 127 is disposed in confrontation with and in separation from the left side of the agitator gear 95 on the lower end thereof by a slight gap so as not to overlap with (to be offset from) the agitator shaft S2, as shown in FIG. 9. Further, the idle-gear-supporting part 133 is inserted into the fitting hole 106 formed in the large-diameter part 104 of the idle gear 94. The left end of the agitator shaft S2 is exposed within the agitator-gear exposure opening 120 in a left side view.

In addition, the upstream circumferential end portion of the detectable gear 96 in the clockwise direction in a left side view is exposed through the detectable-gear exposure opening 123 (see FIG. 10).

The front side of the gear cover 84 is anchored to the left side wall 71 of the developing-cartridge frame 25 by engaging the upper anchoring pawl 124 with the upper engageable part 68 of the developing-cartridge frame 25 and by engaging the lower anchoring pawl 124 with the lower engageable part 68 of the developing-cartridge frame 25.

The rear side of the gear cover 84 is fastened to the left side wall 71 of the developing-cartridge frame 25 by inserting a screw 132 through the upper screw insertion hole 126 formed in the gear cover 84 and the screw insertion hole 130 formed in the collar member 82 and screwing the screw 132 into the upper threaded part 69 of the developing-cartridge frame 25, and by inserting another screw 132 through the lower screw insertion hole 126 formed in the gear cover 84 and screwing the screw 132 into the lower threaded part 69 of the developing-cartridge frame 25.

(3) Driving of the Developing Cartridge

When a drive force is inputted into the development coupling 91, the development coupling 91 transmits the drive force to the supply roller 33, developing roller 34, agitator 29 and detectable gear 96 through the gear train 83.

More specifically, the drive force inputted into the development coupling 91 is transmitted to the developing roller shaft S4 via the gear part 101 of the development gear 92 engaged with the large-diameter gear part 97 of the development coupling 91. The developing roller 34 rotates as a result.

Further, the drive force inputted into the development coupling 91 is transmitted to the supply roller shaft S3 via the supply gear 93 engaged with the small-diameter gear part 98 of the development coupling 91 and is transmitted to the idle gear 94 via the large-diameter part 104 of the idle gear 94 engaged with the small-diameter gear part 98. The supply roller 33 and idle gear 94 rotate as a result.

The drive force inputted into the idle gear 94 is transmitted to the agitator shaft S2 via the agitator gear 95 engaged with the small-diameter part 105 of the idle gear 94. The drive force inputted to the idle gear 94 is also transmitted to the detectable gear 96 engaged with the small-diameter part 105 of the idle gear 94. The agitator 29 and detectable gear 96 are rotated as a result.

4. Main Casing

Figure 12:
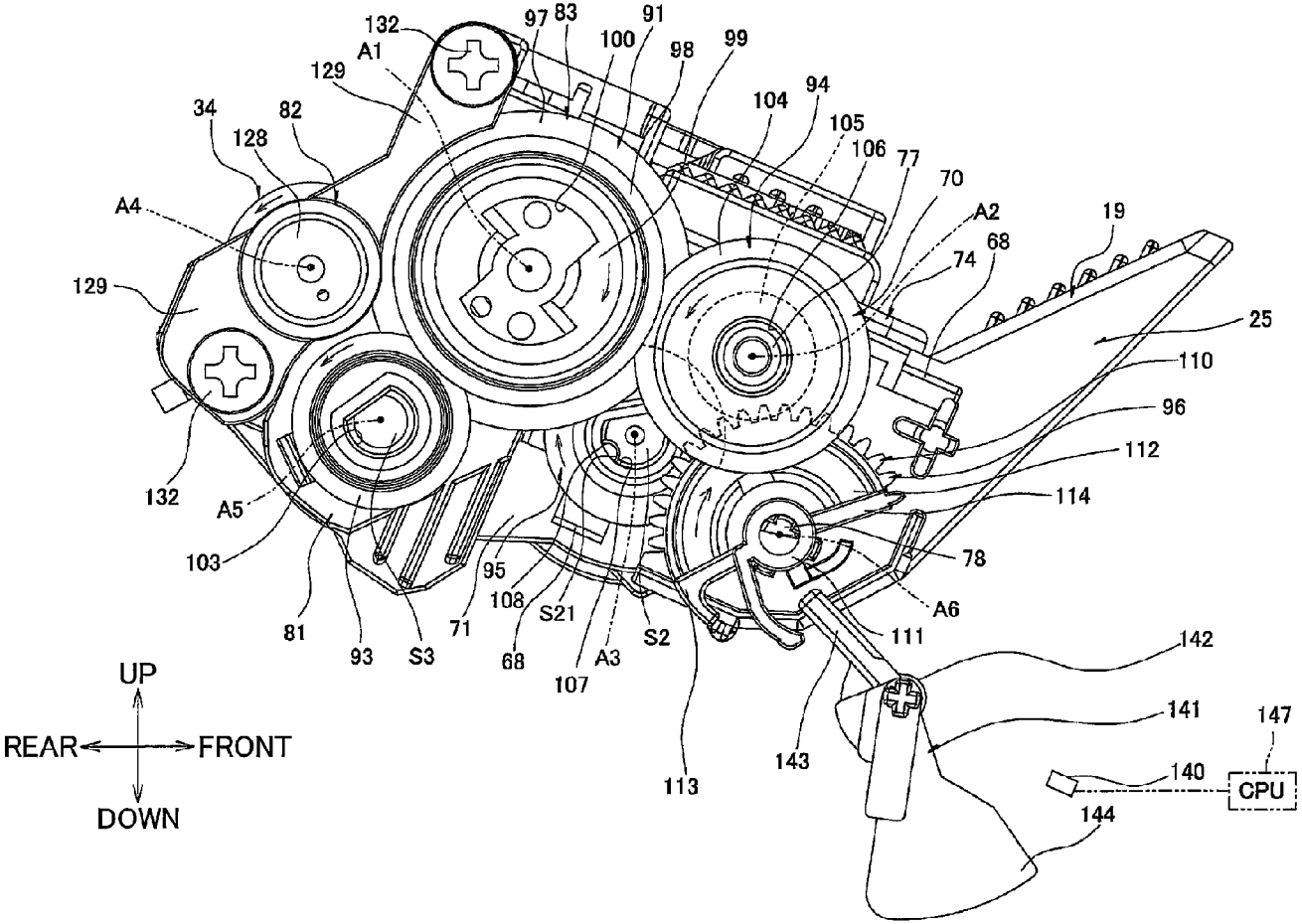
FIG. 12 is an explanatory view explaining the new product sensing operation of the developing cartridge after FIG. 11, wherein the first contact part of the detectable gear is separated rearward from the actuator to place the actuator in a non-detection position.
Figure 13:
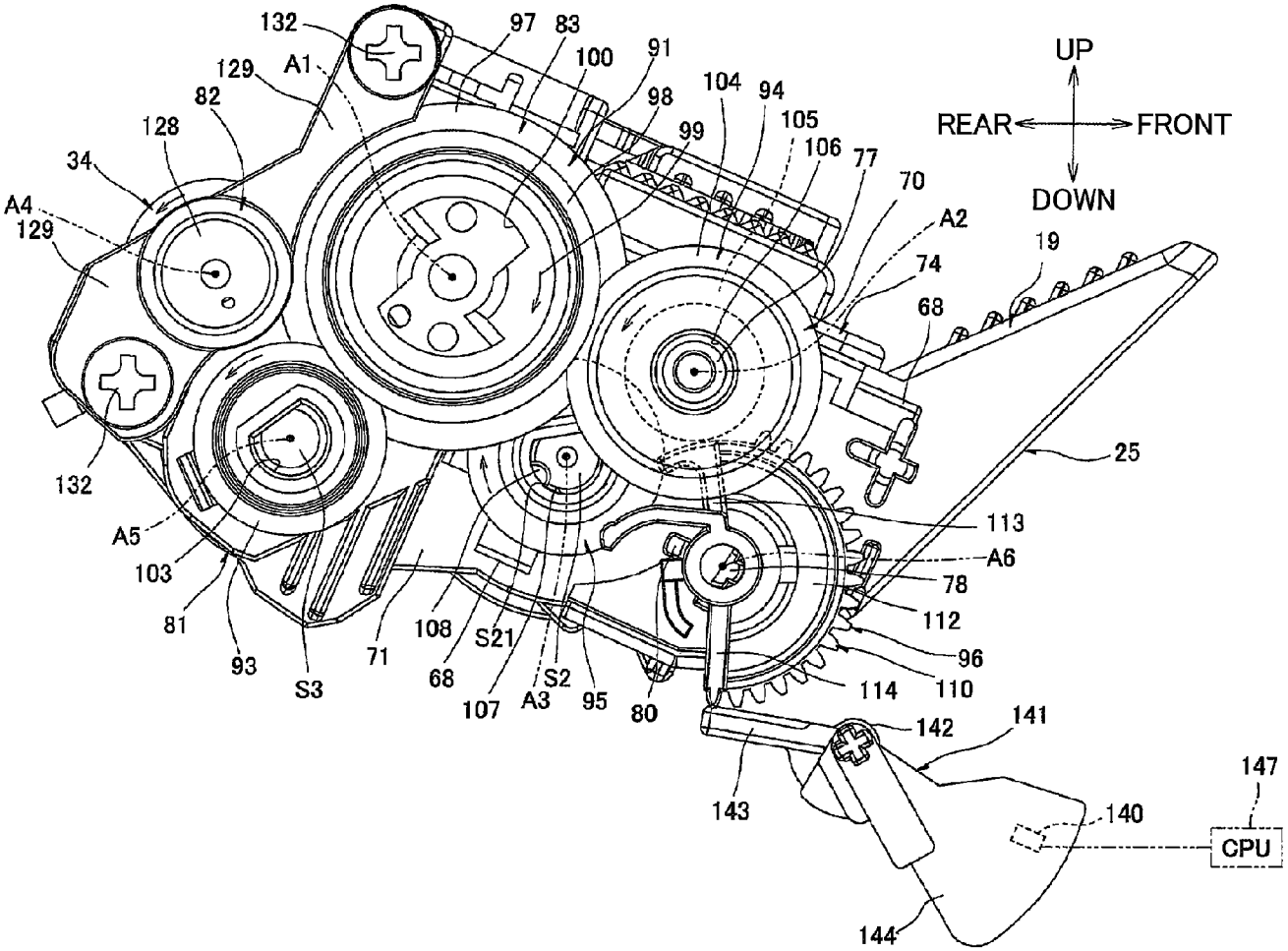
FIG. 13 is an explanatory view explaining the new product sensing operation of the developing cartridge after FIG. 12, wherein a second contact part of the detectable gear is in contact with the actuator to place the actuator in the detection position.

As shown in FIGS. 11 through 13, an actuator 141 is provided in the main casing 2 as a sensor.

The actuator 141 is disposed in a left end portion of the main casing 2 and positioned diagonally upward and forward of the pickup roller 11 (see FIG. 1). The actuator 141 includes a pivot shaft 142, a sensing part 143, and an operating part 144.

The pivot shaft 142 is formed in a general columnar shape that is elongated in the left-right direction.

The sensing part 143 is formed in a rail-like shape and extends upward and rearward from an upper rear end portion of the pivot shaft 142.

The operating part 144 is formed in a plate shape having a general fan shape and extends downward from a bottom end portion of the pivot shaft 142.

The actuator 141 is pivotally movably supported in the main casing 2 at the pivot shaft 142.

With this configuration, the actuator 141 can pivot between a non-detection position (see FIG. 12) in which the sensing part 143 is erected toward the upper rear side, and a detection position (see FIG. 11) in which the sensing part 143 leans toward the rear. An urging member (not shown) constantly urges the actuator 141 toward the non-detection position.

When the actuator 141 is in the non-detection position, a sensor 140 (an optical sensor, for example) provided in the main casing 2 does not detect the operating part 144. In this state, the sensor 140 does not output a detection signal (sensor: OFF).

When the actuator 141 is in the detection position, the sensor 140 detects the operating part 144. In this state, the sensor 140 outputs the detection signal (sensor: ON).

As indicated by phantom lines in FIGS. 11 to 13, a CPU 147 is provided in the main casing 2.

The CPU 147 is electrically connected to the sensor 140 described above. The CPU 147 is configured to receive the detection signal from the sensor 140.

As will be described later in greater detail, the CPU 147 determines whether the developing cartridge 19 is mounted in or removed from the main casing 2 and whether the developing cartridge 19 is new or used based on results of the sensor 140 detecting the pivoting of the actuator 141.

5. Mounting the Developing Cartridge in the Main Casing (1) Mounted State of the Developing Cartridge in the Drum Cartridge When the developing cartridge 19 is mounted in the cartridge-mounting section 60 of the drum cartridge 18 as shown in FIG. 10, the detectable gear 96 is exposed at the lower front side of the drum-cartridge frame 51 through the detectable-gear exposure opening 123 formed in the gear cover 84 and the detectable-gear exposure opening 61 formed in the drum-cartridge frame 51.

(2) Mounting the Process Cartridge in the Main Casing

To mount the process cartridge 15 in the main casing 2, first the top cover 7 of the main casing 2 is placed in the open position described above, as shown in FIG. 1.

Next, the operator grips the front end portion of the drum cartridge 18 and inserts the process cartridge 15 into the main casing 2 so that both left and right ends of the drum shaft 51 of the photosensitive drum 20 are fitted into the guide parts 37 provided in the main casing 2.

Next, the operator pushes the process cartridge 15 diagonally downward and rearward along the guide parts 37 and subsequently rotates the process cartridge 15 clockwise in a left side view about the drum shaft 51 of the photosensitive drum 20.

Mounting of the process cartridge 15 in the main casing 2 is complete when the drum shaft S1 of the photosensitive drum 20 is positioned in the rear ends of the guide parts 37 and the front end portion of the drum cartridge 18 is positioned lower than the irradiation path of the laser beam L so as not to interfere with the laser beam L.

At this time, as shown in FIG. 11, the upstream circumferential end portion of the detectable gear 96 in the clockwise direction in a left side view contacts the sensing part 143 of the actuator 141 from above.

Through this contact, the actuator 141 pivots counterclockwise in a left side view against the urging force of the urging member (not shown) and is placed in the detection position.

Subsequently, the operator places the top cover 7 of the main casing 2 in the closed position.

To remove the process cartridge 15 from the main casing 2, the operations of the process cartridge 15 and main casing 2 are performed in reverse from the mounting operations described above.

Specifically, after placing the top cover 7 in the open position, the operator pulls the process cartridge 15 diagonally upward and forward.

When the operator pulls the process cartridge 15 in this way, the detectable gear 96 of the developing cartridge 19 is raised above and separated from the sensing part 143 of the actuator 141. Accordingly, the urging force of the urging member (not shown) causes the actuator 141 to pivot clockwise in a left side view and places the actuator 141 in the non-detection position (see FIG. 12).

6. New Product Sensing Operation

When the top cover 7 of the main casing 2 is placed in its closed position, the coupling protrusion 47 of the main coupling 46 provided in the main casing 2 (see FIG. 4) moves in association with the closing operation for the top cover 7 and is fitted into the development coupling 91 of the developing cartridge 19 so as to be incapable of rotating relative to the development coupling 91.

Subsequently, a drive source (not shown) provided in the main casing 2 transmits a drive force through the coupling protrusion 47 of the main coupling 46 for rotating the development coupling 91 clockwise in a left side view and for initiating a warm-up operation.

Thus, as described above and shown in FIG. 11, the drive force is transmitted to the agitator gear 95 through the gear train 83 and drives the agitator 29.

The gear train 83 also transmits this drive force to the detectable gear 96, causing the detectable gear 96 to rotate clockwise in a left side view.

Through this operation, the first contact part 113 of the detectable gear 96 moves rearward and separates from the sensing part 143 of the actuator 141, as shown in FIG. 12.

Consequently, the urging force of the urging member (not shown) causes the actuator 141 to pivot clockwise in a left side view until the actuator 141 arrives in the non-detection position.

As the detectable gear 96 further rotates and the second contact part 114 contacts the sensing part 143 of the actuator 141 on the upper front side thereof, as illustrated in FIG. 13, the second contact part 114 of the detectable gear 96 pushes the sensing part 143 of the actuator 141 diagonally downward and rearward.

This pressure causes the actuator 141 to pivot counterclockwise in a left side view against the urging force of the urging member (not shown), moving the actuator 141 from the non-detection position to the detection position.

At this time, the upstream-most end of the toothed part 112 in its rotating direction moves forward and separates from the small-diameter part 105 of the idle gear 94. As a result, the detectable gear 96 is disengaged from the small-diameter part 105 of the idle gear 94.

When the sensor 140 detects that the actuator 141 has moved sequentially from the detection position to the non-detection position and back to the detection position (more specifically, when the CPU 147 receives the detection signal from the sensor 140 (sensor: ON), but stops receiving the detection signal from the sensor 140 thereafter (sensor: OFF), and then receives the detection signal from the sensor 140 again (sensor: ON)), the CPU 147 in the main casing 2 determines that the developing cartridge 19 has not been used (information related to the developing cartridge 19).

When a used developing cartridge 19 is mounted in the main casing 2, the engagement between the detectable gear 96 and idle gear 94 has been cancelled. Accordingly, the detectable gear 96 will not rotate when the developing cartridge 19 is remounted, and the second contact part 114 of the detectable gear 96 will remain in contact with the sensing part 143 of the actuator 141 from above.

Consequently, the actuator 141 will remain disposed in the detection position.

When the sensor 140 detects that the actuator 141 has remained in the detection position for a prescribed time (more specifically, when the CPU 147 continues to receive the detection signal from the sensor 140 (sensor: ON) for a prescribed time), the CPU 147 in the main casing 2 determines that the developing cartridge 19 mounted in the main casing 2 is used (information related to the developing cartridge 19).

7. Operational Advantages (1) In the developing cartridge 19 described above, the agitator gear 95 can be arranged closer to the development coupling 91 than the idle gear 94 is to the development coupling 91, as shown in FIG. 11.

Therefore, the development coupling 91 and agitator gear 95 can define a shorter distance therebetween than if the development coupling 91, idle gear 94 and agitator gear 95 were arranged in line.

As a result, the developing cartridge 19 can be made more compact with respect to a direction in which the development coupling 91 and agitator gear 95 oppose each other (i.e., generally front-rear direction).

(2) In the developing cartridge 19 described above, when projected in the left-right direction, the rear end portion of the large-diameter part 104 of the idle gear 94, the rear end portion of the agitator gear 95, the front end portion of the development gear 92 (see FIG. 10), and the front end portion of the supply gear 93 are all overlapped with the rotational path of the development coupling 91, as shown in FIG. 11.

The idle gear 94, agitator gear 95, development gear 92 and supply gear 93 can therefore be arranged efficiently in the vicinity of the development coupling 91.

Further, since the idle gear 94, agitator gear 95, development gear 92 and supply gear 93 are partially overlapped with the rotational path of the development coupling 91, respectively, the developing cartridge 19 can be made more compact.

(3) In the developing cartridge 19 described above, the agitator gear 95 is positioned between the seal-accommodating part 75 and small-diameter part 105 of the idle gear 94, as shown in FIGS. 4, 10 and 11.

Thus, the agitator gear 95 can be arranged efficiently using the space formed between the seal-accommodating part 75 and small-diameter part 105 of the idle gear 94, without requiring an additional space for arranging the agitator gear 95.

The agitator gear 95 can be thus arranged further efficiently and the developing cartridge 19 itself can further be made more compact.

(4) In the developing cartridge 19 described above, as shown in FIGS. 4 and 11, the large-diameter part 104 of the idle gear 94 and supply gear 93 are meshingly engaged with the small-diameter gear part 98 of the development coupling 91 which has fewer gear teeth than the large-diameter gear part 97 engaging the development gear 92.

Further, the agitator gear 95 is intermeshed with the small-diameter part 105 of the idle gear 94.

Thus, the agitator gear 95 and supply gear 93 can rotate at a reduced rotation speed than the rotation seed of the development gear 92. The rotation speed of the supply roller 33 and agitator 29 can therefore be made slower than the rotation speed of the developing roller 34.

This structure can serve to adjust the amount of toner supplied to the developing roller 34 by the rotation of the agitator 29 and supply roller 33, thereby preventing excessive toner supply to the developing roller 34.

(5) As shown in FIG. 4, the small-diameter gear part 98 is positioned leftward (outward in the left-right direction) of the large-diameter gear part 97.

That is, the large-diameter gear part 97 intermeshing the development gear 92 is positioned on the right, and is arranged near the developing-cartridge frame 25 (closer to the side wall 71 of the developing-cartridge frame 25 than the small-diameter gear part 98 is).

This structure can reduce occurrence of wobbling of the large-diameter gear part 97, compared to the small-diameter gear part 98, when the drive force is inputted to the development coupling 91. Hence, the drive force can be stably transmitted from the development coupling 91 to the development gear 92, resulting in stable rotation of the developing roller 34.

Incidentally, the developing roller 34 is required to rotate with higher accuracy than the supply roller 33, since the developing roller 34 develops the electrostatic latent image formed on the photosensitive drum 20. In this regard, stable rotation of the developing roller 34 in the developing cartridge 19 described above can realize stable development of the electrostatic latent image on the photosensitive drum 20.

(6) Also as shown in FIG. 4, the agitator gear 95 is positioned rightward of the development coupling 91 in the above-described developing cartridge 19.

This structure can prevent interference between the development coupling 91 and agitator gear 95, while realizing efficient arrangement of the agitator gear 95.

(7) In the developing cartridge 19 described above, the detectable gear 96 is arranged between the agitator gear 95 and large-diameter part 104 of the idle gear 94, as shown in FIGS. 4 and 11.

This structure can bring the detectable gear 96 and agitator gear 95 close to each other, while preventing interference between the detectable gear 96 and agitator gear 95. As a result, efficient arrangement between the detectable gear 96 and agitator gear 95 can be obtained, rendering the developing cartridge 19 more compact.

(8) According to the above-described developing cartridge 19, as shown in FIGS. 4 and 11, the detectable gear 96 is brought into engagement with the small-diameter part 105 of the idle gear 94 which is configured to rotate at a slower speed than the development gear 92 rotates. The rotation speed of the detectable gear 96 can therefore be reduced.

Thus, the detectable gear 96 can be subject to detection for a longer period of time, thereby ensuring reliable detection of the detectable gear 96.

(9) As shown in FIG. 11, the rear end portion of the detectable gear 96 is overlapped with the agitator gear 95 when projected in the left-right direction. Hence, the detectable gear 96 and agitator gear 95 are made closer to each other. This structure can realize efficient arrangement of the detectable gear 96 and agitator gear 95, contributing to further downsizing of the developing cartridge 19.

(10) In the developing cartridge 19 described above, the agitator gear 95 cannot be fitted to the agitator shaft S2 unless the protrusion 108 of the agitator gear 95 is fitted into the recess S21 of the agitator shaft S2, as shown in FIG. 11.

In other words, when the agitator gear 95 is fitted to the agitator shaft S2, positioning of the agitator gear 95 relative to the agitator shaft S2 is performed by fitting the protrusion 108 of the agitator gear 95 into the recess S21 of the agitator shaft S2. The agitator gear 95 can be therefore fitted to the agitator shaft S2 with accuracy.

Hence, the drive force can be stably transmitted to the agitator 29 through the agitator gear 95, resulting in stable rotation of the agitator 29.

Further, the protrusion 108 is formed to protrude inward from the inner circumferential surface of the agitator-shaft fitting hole 107. That is, the direction in which the protrusion 108 protrudes (i.e., the radial direction of the agitator gear 95) is perpendicular to the left-right direction (axial direction). This structure can make the agitator gear 95 more compact with respect to the left-right direction than if the protrusion 108 were formed to protrude outward in the left-right direction.

Further, as shown in FIG. 7, the protrusion 108 is positioned so as not to overlap with the symmetrical axis V (see the phantom line in FIG. 7) of the agitator-shaft fitting hole 107 in a slide view.

With this structure, if the agitator gear 95 were to be fitted to the agitator shaft S2 in a reversed orientation (with left and right surfaces arranged in reverse), the protrusion 108 cannot be fitted in the recess S21 of the agitator shaft S2. This structure can ensure correct fitting of the agitator gear 95 to the agitator shaft S2 without errors in the left-right arrangement of the agitator gear 95. Thus the agitator gear 95 can be fitted to the agitator shaft S2 with accuracy.

(11) As shown in FIGS. 6 and 9, the gear cover 84 includes the anchoring pawl 124 engaged with the lower engageable part 68 of the developing-cartridge frame 25 at a position rightward of the agitator gear 95, and the restricting protrusion 127 opposing the left end of the lower end portion of the agitator gear 95 so as not to be overlapped with the agitator shaft S2.

With this structure, utilizing the restricting protrusion 127 of the gear cover 84, the agitator gear 95 is restricted from moving with respect to the left-right direction, while requiring less number of parts.

Further, since the restricting protrusion 127 is positioned to oppose the lower end portion of the agitator gear 95 so as not to overlap with the agitator shaft S2, the agitator gear 95 can be arranged closer to the development coupling 91, making the developing cartridge 19 more compact.

Incidentally, as shown in FIG. 7, the left end of the agitator shaft S2 is exposed within the agitator-gear exposure opening 120 formed above the restricting protrusion 127 in a side view. Thus, through the agitator-gear exposure opening 120, the phase of the agitator 29 (position of the agitator 29 in the rotational direction thereof) can be confirmed.

Therefore, prior to shipping of the developing cartridge 19, the phase of the agitator 29 can be adjusted so as to reduce a resistive force that will be applied (exerted) from the toner within the toner-accommodating chamber 26 when the developing cartridge 19 is driven for the first time. The agitator 29 is thus prevented from getting damaged due to the resistive force to be applied from the toner within the toner-accommodating chamber 26 when the developing cartridge 19 is first driven.

8. First Modification

A developing cartridge 19 according to a first modification of the present invention will now be described with reference to FIG. 14, wherein like parts and components are designated with the same reference numerals as those of the first embodiment and explanations therefor are omitted.

Figure 14:
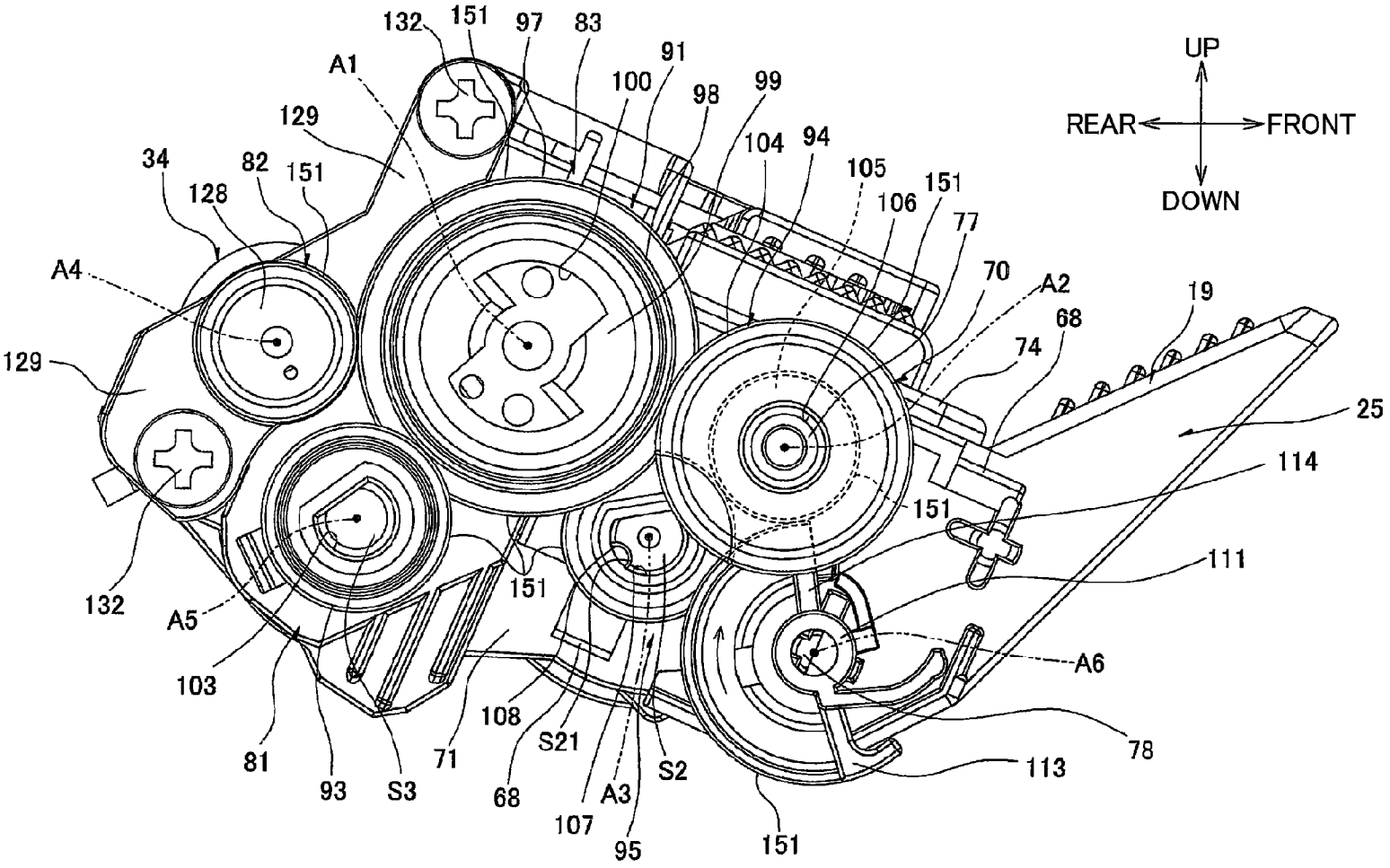
FIG. 14 is an explanatory view explaining a developing cartridge according to a first modification of the present invention.

Arrows in FIG. 14 indicate directions based on a state where the developing cartridge 19 according to the first modification is mounted in the main casing 2.

The gear train 83 of the first embodiment provided in the drive unit 70 serves as a drive-force transmission mechanism. However, the drive-force transmission mechanism may be configured of friction wheels without gear teeth.

More specifically, as shown in FIG. 14, in place of the gear teeth, a resistance-applying member 151 formed of a rubber or other material having a relatively high coefficient of friction is provided at least on the outer circumferential surface of each gear constituting the gear train 83.

Thus, friction generated between the resistance-applying members 151 functions to transmit a drive force.

This first modification can obtain the same operational advantages described above for the first embodiment.

9. Second Modification

A developing cartridge 19 according to a second modification of the present invention will now be described with reference to FIG. 15, wherein like parts and components are designated with the same reference numerals as those of the first embodiment and explanations therefor are omitted.

Figure 15:
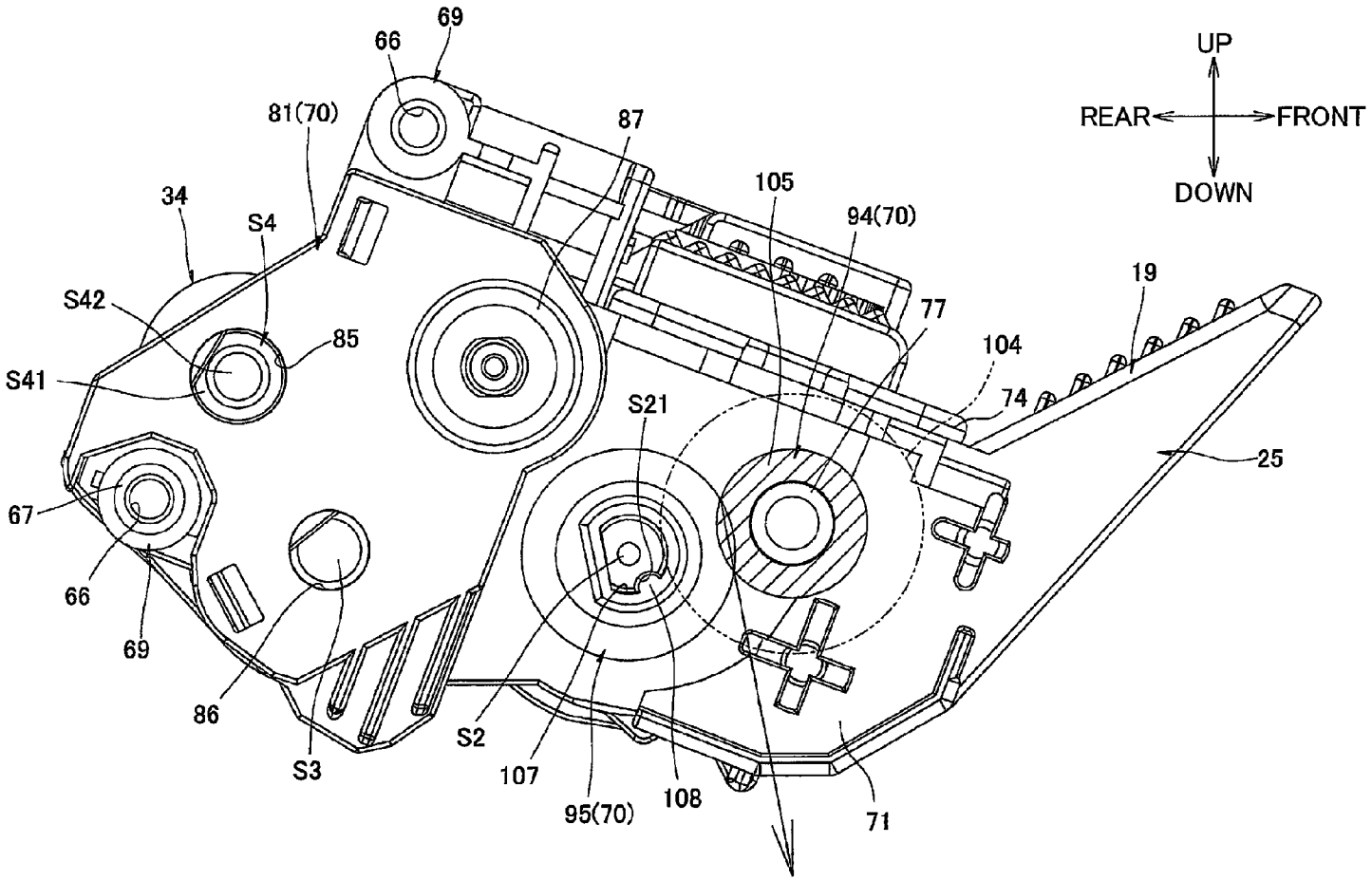
FIG. 15 is an explanatory view explaining a developing cartridge according to a second modification of the present invention.

Arrows in FIG. 15 indicate directions based on a state where the developing cartridge 19 according to the second modification is mounted in the main casing 2.

Based on the configuration of the first embodiment, the idle gear 94 of the second modification is configured such that the idle gear 94 transmits a drive force toward a direction generally vertically downward relative to the agitator gear 95 (i.e., generally frontward and downward, as indicated by an arrow in FIG. 15) at the portion where the idle gear 94 engages the agitator gear 95 (drive-force transmission portion), as shown in FIG. 15.

With this structure of the second modification, the drive force can be inputted to the agitator gear 95 toward the lower end portion of the toner-accommodating chamber 26 where the toner therein is accumulated due to gravity. As a result, the toner within the toner-accommodating chamber 26 can be agitated reliably.

10. Other Variations (1) In the first embodiment described above, an optical sensor or other non-contact sensor is used to detect the pivoting motion of the actuator 141. However, a mechanical switch or another contact sensor may be used for detecting this motion.

(2) Further, the printer 1 described above is an example of the image forming device of the present invention, but the present invention is not limited to the depicted embodiment.

The image forming device of the present invention may be configured as a monochromic printer or a color printer.

If the image forming device is configured as a color printer, available examples are: a direct tandem color printer provided with a plurality of photosensitive members and a recording medium conveying member; and an intermediate-transfer-type tandem color printer provided with a plurality of photosensitive members, an intermediate transfer body, and a transfer member.

Other than the process cartridge 15 having a separable structure that allows the drum cartridge 18 and developing cartridge 19 to be detached from each other as described above, the process cartridge 15 may be formed as an integrated unit in which the drum cartridge 18 and developing cartridge 19 are integrally provided.

It is also possible to provide the photosensitive drum 20 in the main casing 2, while enabling only the developing cartridge 19 to be mounted in and removed from the main casing 2.

Further, instead of the photosensitive drum 20 described above, other types of photosensitive members, such as a photosensitive belt may be used.

Further, as the developer carrier of the present invention, a developing sleeve, developing belt, brush roller, or other device, may be used in place of the developing roller 34.

Further, as an example of the supply member, a device other than the supply roller 33, such as a supply sleeve, a supply belt, or a brush roller, may also be available.

Further, as an example of the agitator, a device other than the agitator 29, such as an auger screw or a conveying belt, may also be used.

Further, instead of the transfer roller 21, a contact-type transfer member, including a transfer belt, a transfer brush, a transfer blade, and a film-like transfer device, or a non-contact-type transfer member, including a corotron-type transfer member may also be used as a transfer member.

Further, other than the scorotron charger 22 described above, a non-contact type device, including a corotron-type charger, and a charger provided with a sawtooth discharge member, or a contact-type charger such as a charging roller are also available as a charger.

Further, while the scanning unit 16 described above is an example of an exposing member, a device other than the scanning unit 16, such as an LED unit may be used as the exposing member.

The cartridge of the present invention may be configured as a toner box (toner cartridge) without possessing a developer carrier such as a developing roller.

Further, the image forming device of the present invention may be configured as a multifunction device provided with an image scanner.

While the invention has been described in detail with reference to the embodiments thereof, it would be apparent to those skilled in the art that various changes and modifications may be made therein without departing from the scope of the invention.

What is claimed is:

1. A cartridge comprising:

a casing including a developer accommodation part configured to accommodate developer therein;

an agitator defining a first rotational axis extending in an axial direction and configured to rotate about the first rotational axis and agitate the developer within the developer accommodation part;

a receiving member configured to rotate about a second rotational axis upon receipt of a drive force inputted thereto;

a first drive-force transmission member configured to rotate about a third rotational axis upon receipt of the drive force from the receiving member; and a second drive-force transmission member configured to contact the first drive-force transmission member and receive the drive force therefrom, the second drive-force transmission member being configured to rotate about the first rotational axis together with the agitator, the first rotational axis being positioned closer to the second rotational axis than the third rotational axis is to the second rotational axis when projected in the axial direction of the agitator.

2. The cartridge as claimed in claim 1, further comprising:

a developer carrier configured to carry developer thereon;

a supply member configured to supply the developer to the developer carrier;

a third drive-force transmission member configured to rotate together with the developer carrier; and a fourth drive-force transmission member configured to rotate together with the supply member, wherein the receiving member defines a rotational path while rotating about the second rotational axis, a portion of the first drive-force transmission member, a portion of the second drive-force transmission member, a portion of the third drive-force transmission member and a portion of the fourth drive-force transmission member being overlapped with the rotational path of the receiving member when projected in the axial direction.

3. The cartridge as claimed in claim 2, wherein:

the casing comprises a seal accommodation part protruding outward relative to the developer accommodation part in the axial direction;

the supply member extends in the axial direction and has one axial end portion in the axial direction, the seal accommodation part being configured to accommodate a seal member for sealing the axial end portion of the supply member; and the second drive-force transmission member is positioned between the seal accommodation part and the first drive-force transmission member.

4. The cartridge as claimed in claim 2, wherein:

the receiving member comprises a first gear part having gear teeth and a second gear part having fewer gear teeth than the first gear part;

the third drive-force transmission member includes gear teeth configured to be engaged with the first gear part;

the first drive-force transmission member includes gear teeth configured to be engaged with the second gear part, and the fourth drive-force transmission member includes gear teeth configured to be engaged with the second gear part; and the second drive-force transmission member includes gear teeth configured to be engaged with the first drive-force transmission member.

5. The cartridge as claimed in claim 4, wherein the second gear part is arranged outward of the first gear part in the axial direction.

6. The cartridge as claimed in claim 1, wherein the second drive-force transmission member is arranged inward of the receiving member in the axial direction.

7. The cartridge as claimed in claim 1, further comprising a detected member, wherein the first drive-force transmission member comprises:

a first portion configured to receive the drive force from the receiving member; and a second portion arranged inward of the first portion in the axial direction and integrally formed with the first portion, the second portion being configured to transmit the drive force inputted from the receiving member to the second drive-force transmission member, the detected member being positioned outward of the second drive-force transmission member and inward of the first portion in the axial direction and configured to receive the drive force from the second portion.

8. The cartridge as claimed in claim 7, wherein:

the second portion includes gear teeth extending in the axial direction, the gear teeth having an inner end portion in the axial direction;

the second drive-force transmission member includes gear teeth configured to be engaged with the inner end portion of the gear teeth of the second portion; and the detected member includes gear teeth configured to be engaged with the gear teeth of the second portion, the detected member engaging the second portion at a position outward of the second drive-force transmission member in the axial direction.

9. The cartridge as claimed in claim 7, wherein the detected member has a portion overlapped with the second drive-force transmission member when projected in the axial direction.

10. The cartridge as claimed in claim 1, wherein:

the agitator includes a rotational shaft extending in the axial direction and defining the first rotational axis, the rotational shaft having an outer end portion in the axial direction;

the second drive-force transmission member is formed with a fitting hole configured to be fitted with the rotational shaft, the fitting hole being defined by an inner peripheral surface having an outermost end portion in the axial direction, the second drive-force transmission member further including a protruding portion protruding radially inward from the outermost end portion of the inner peripheral surface; and the rotational shaft further includes a recess formed on the outer end portion and configured to be fitted with the protruding portion.

11. The cartridge as claimed in claim 1, further comprising a cover member configured to cover the second drive-force transmission member from outside in the axial direction, the cover member comprising:

an engaging part configured to be engaged with the casing at a position inward of the second drive-force transmission member in the axial direction; and an opposing part configured to oppose the second drive-force transmission member from outside in the axial direction at a position offset from the first rotational axis of the second drive-force transmission member.

12. An image forming device comprising:

a main body; and a cartridge configured to be mounted in and removed from the main body, the cartridge comprising:

a casing including a developer accommodation part configured to accommodate developer therein;

an agitator defining a first rotational axis extending in an axial direction and configured to rotate about the first rotational axis and agitate the developer within the developer accommodation part;

a receiving member configured to rotate about a second rotational axis upon receipt of a drive force inputted thereto;

a first drive-force transmission member configured to rotate about a third rotational axis upon receipt of the drive force from the receiving member; and a second drive-force transmission member configured to contact the first drive-force transmission member and receive the drive force therefrom, the second drive-force transmission member being configured to rotate about the first rotational axis together with the agitator, the first rotational axis being positioned closer to the second rotational axis than the third rotational axis is to the second rotational axis when projected in the axial direction of the agitator, wherein, when the cartridge is mounted in the main body, the first drive-force transmission member is configured to transmit the drive force to the second drive-force transmission member at a drive-force transmission portion, the drive force being oriented toward vertically below relative to the second drive-force transmission member at the drive-force transmission portion.

* * * * *